US007600854B2

(12) United States Patent
Fukasawa

(10) Patent No.: US 7,600,854 B2
(45) Date of Patent: Oct. 13, 2009

(54) LIQUID EJECTION DEVICE AND LIQUID EJECTION METHOD

(75) Inventor: Kenji Fukasawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 12/137,415

(22) Filed: Jun. 11, 2008

(65) Prior Publication Data

US 2008/0309709 A1 Dec. 18, 2008

(30) Foreign Application Priority Data

Jun. 14, 2007 (JP) ..... 2007-157879

(51) Int. Cl.
*B41J 2/15* (2006.01)
*B41J 1/145* (2006.01)

(52) U.S. Cl. ..... 347/40; 347/42; 347/43

(58) Field of Classification Search ..... 347/15, 347/40–43, 47

See application file for complete search history.

(56) References Cited

U.S. PATENT DOCUMENTS 6,244,688 B1 * 6/2001 Hickman ..... 347/43
2008/0117249 A1 * 5/2008 Childers et al. ..... 347/19

FOREIGN PATENT DOCUMENTS

JP 2007-068202 3/2007

* cited by examiner

*Primary Examiner*—Thinh H Nguyen
(74) *Attorney, Agent, or Firm*—Hogan & Hartson LLP

(57) ABSTRACT

A liquid ejection device includes a plurality of deep nozzle lines each having a plurality of nozzles in a predetermined direction, for ejecting a first liquid, and a smaller number of light nozzle lines than the number of the deep nozzle lines, each having a plurality of nozzles in the predetermined direction, for ejecting a second liquid having a lighter color depth than the first liquid. A controller forms deep dots on pixels on a medium using the plurality of deep nozzle lines, and forms light dots on a smaller number of pixels than the number of the pixels on which the deep dots are formed using the smaller number of light nozzle lines.

14 Claims, 22 Drawing Sheets

FIG. 5A
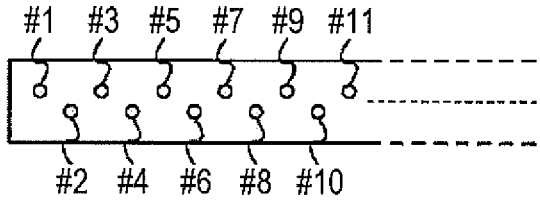
FIG. 5B
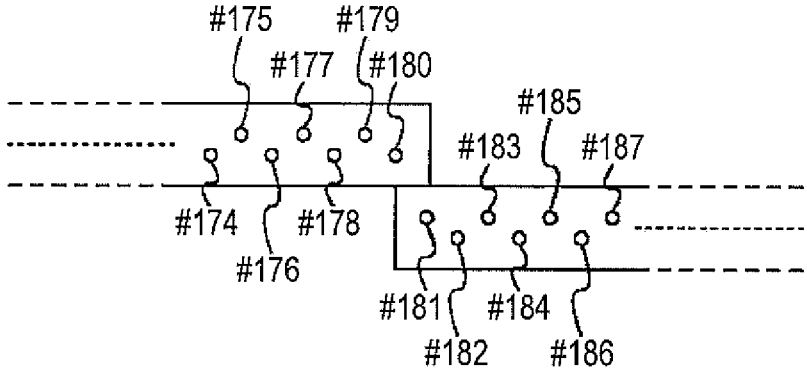
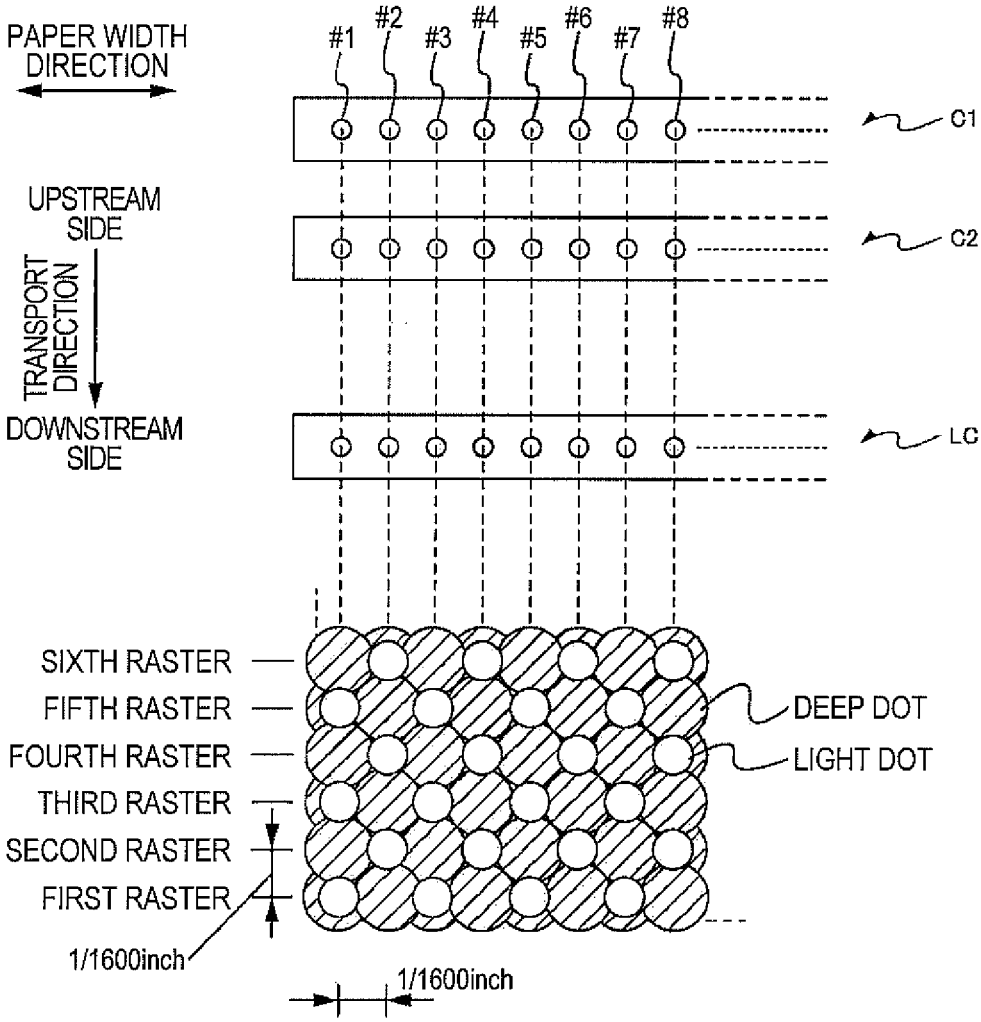
FIG. 6

LIQUID EJECTION DEVICE AND LIQUID EJECTION METHOD

CROSS REFERENCE TO RELATED APPLICATIONS

This application claims the benefit under 35 USC 119 of Japanese patent application number 2007-157879, filed on Jun. 14, 2007, the contents of which are incorporated herein by reference.

BACKGROUND

1. Technical Field

The present invention relates to a liquid ejection device and a liquid ejection method.

2. Related Art

An inkjet printer is a liquid ejection device for ejecting a liquid (e.g., ink) to a medium (e.g., paper, cloth, or an OHP sheet). In an inkjet printer, a dot forming process for ejecting ink droplets from a head while moving a carriage and a transport process for transporting paper are repeated alternately, thereby printing an image composed of dots on the paper. One type of inkjet printer is a line printer that uses a head having a width corresponding to the width of the paper, instead of moving the head with a carriage (see JP-A-2007-68202).

When representing the highest gray-scale, ink must be applied without a gap so that the basic color of the medium becomes invisible. Therefore, in order to make it possible to form deep dots in a number of pixels, a plurality of deep nozzle lines for ejecting deep ink is sometimes provided.

It should be noted that if the same number of light nozzle lines for ejecting light ink as the number of the deep nozzle lines are provided, the total number of nozzles increases, thus increasing the manufacturing cost.

SUMMARY

An advantage of the invention is to decrease the number of nozzle lines.

According to a first aspect of the invention, a liquid ejection device includes a plurality of deep nozzle lines each having a plurality of nozzles in a predetermined direction, for ejecting a first liquid, and a smaller number of light nozzle lines than the number of the deep nozzle lines, each having a plurality of nozzles in the predetermined direction, for ejecting a second liquid having a lighter color depth than the first liquid. A controller forms deep dots on pixels on a medium using the plurality of deep nozzle lines, and forms light dots on a smaller number of pixels than the number of the pixels on which the deep dots are formed using the smaller number of light nozzle lines.

According to the liquid ejection device described above, the number of the nozzle lines is decreased.

In the liquid ejection device according to this aspect of the invention, when liquid is ejected from one of the nozzles, liquid is preferably not ejected from a nozzle adjacent to the one of the nozzles. Thus, when a certain nozzle ejects liquid, the influence of an adjacent nozzle is eliminated.

In the liquid ejection device according to this aspect of the invention, when one of the nozzles forms a dot on one of the pixels, a dot is preferably not formed on another of the pixels which the one of the nozzles is opposed to subsequently to the one of the pixels. Thus, a higher print speed is achieved.

In the liquid ejection device according to this aspect of the invention, the plurality of deep nozzle lines preferably includes a first deep nozzle line and a second deep nozzle line. The first deep nozzle line forms the deep dots, and then the second deep nozzle line forms the deep dots. Each of the light nozzle lines forms the light dots selectively not on pixels on which deep dots are formed by the second deep nozzle line but on pixels on which deep dots are formed by the first deep nozzle line. Thus, running of colors is prevented.

In the liquid ejection device according to this aspect of the invention, the deep dots are preferably larger than the light dots. Thus, preventing granularity in an area with a faint color from becoming conspicuous and representing the area with a deep color are both satisfied easily.

In the liquid ejection device according to this aspect of the invention, the plurality of deep nozzle lines preferably includes a plurality of deep cyan nozzle lines for ejecting deep cyan ink as the first liquid to form deep cyan dots as the deep dots. The light nozzle lines preferably include a light cyan nozzle line for ejecting light cyan ink as the second liquid to form light cyan dots as the light dots. The liquid ejection device further preferably includes a plurality of deep magenta nozzle lines each having a plurality of nozzles in the predetermined direction, for ejecting deep magenta ink to form deep magenta dots, and a smaller number of light magenta nozzle lines than the number of the deep nozzle lines, each having a plurality of nozzles in the predetermined direction, for ejecting light magenta ink having a lighter color depth than the deep magenta ink to form light magenta dots. The light magenta dots are disposed between the light cyan dots. Thus, the granularity is reduced, and image quality is improved.

Further, according to another aspect of the invention, a liquid ejection method includes the steps of forming deep dots on pixels on a medium by ejecting a first liquid using a plurality of deep nozzle lines each having a plurality of nozzles in a predetermined direction, and forming light dots on a smaller number of pixels than the number of the pixels on which the deep dots are formed by ejecting a second liquid having a lighter color depth than the first liquid using a smaller number of light nozzle lines than the number of the deep nozzle lines, each having a plurality of nozzles in the predetermined direction.

According to the liquid ejection method described above, the number of the nozzle lines is decreased.

Other aspects of the invention will be apparent from the present specification and the accompanying drawings.

BRIEF DESCRIPTION OF THE DRAWINGS

The invention will now be described with reference to the accompanying drawings, wherein like numbers refer to like elements.

FIGS. 5A and 5B are explanatory diagrams of an arrangement of the nozzles.

FIG. 6 is an explanatory diagram of a dot forming method according to a first embodiment of the invention.

DESCRIPTION OF EXEMPLARY EMBODIMENTS

Configuration of Printing System

A printing system according to an embodiment of the invention will now be explained with reference to the accompanying drawings. The following description includes embodiments related to a computer program and a recording medium recording the computer program.

Figure 1:
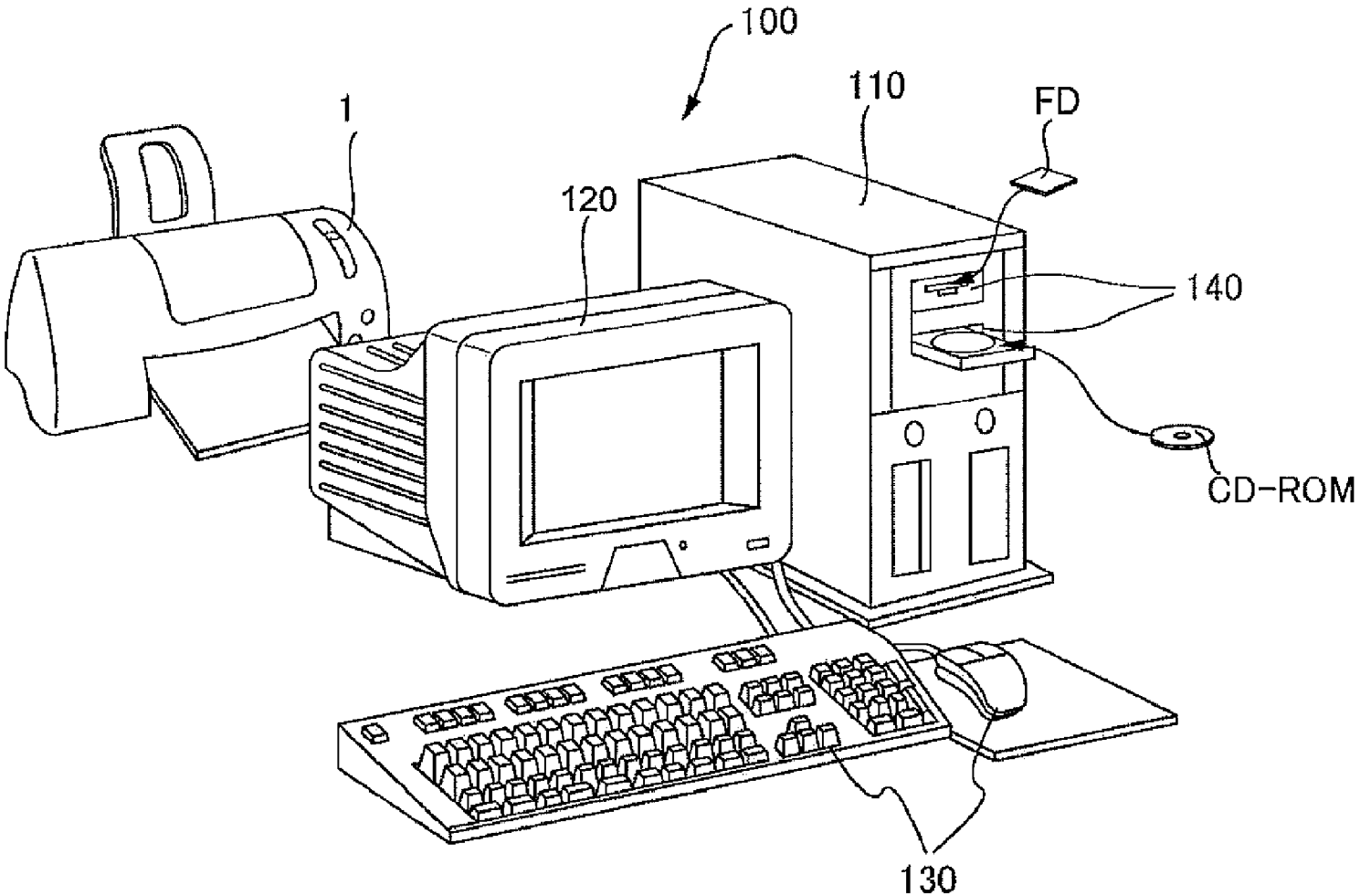
FIG. 1 is a perspective view of a printing system according to the present invention.

FIG. 1 is a perspective view of a printing system 100. The printing system 100 comprises a printer 1, a computer 110, a display device 120, an input device 130, and a recording/reproducing device 140. The printer 1 is a printing device for printing an image on a medium such as paper, cloth, or a film. The computer 110 is connected to the printer 1 in a communicable manner, and outputs print data corresponding to an image to be printed to the printer 1.

The computer 110 has a printer driver installed therein. The printer driver is a program for making the display device 120 display a user interface and converting image data output from an application program into print data. The printer driver is recorded on a computer readable recording medium such as a flexible disk FD or a CD-ROM. Alternatively, the print driver can be downloaded to the computer 110 via the Internet. The program is composed of codes for realizing various functions.

A "printing device" denotes a device for printing an image on a medium, and corresponds, for example, to the printer 1. A "printing control device" denotes a device for controlling the printing device, and corresponds, for example, to a computer having the printer driver installed thereto. A "printing system" denotes a system including at least the printing device and the printing control device.

Configuration of Printer

Configuration of Inkjet Printer

Figure 2:
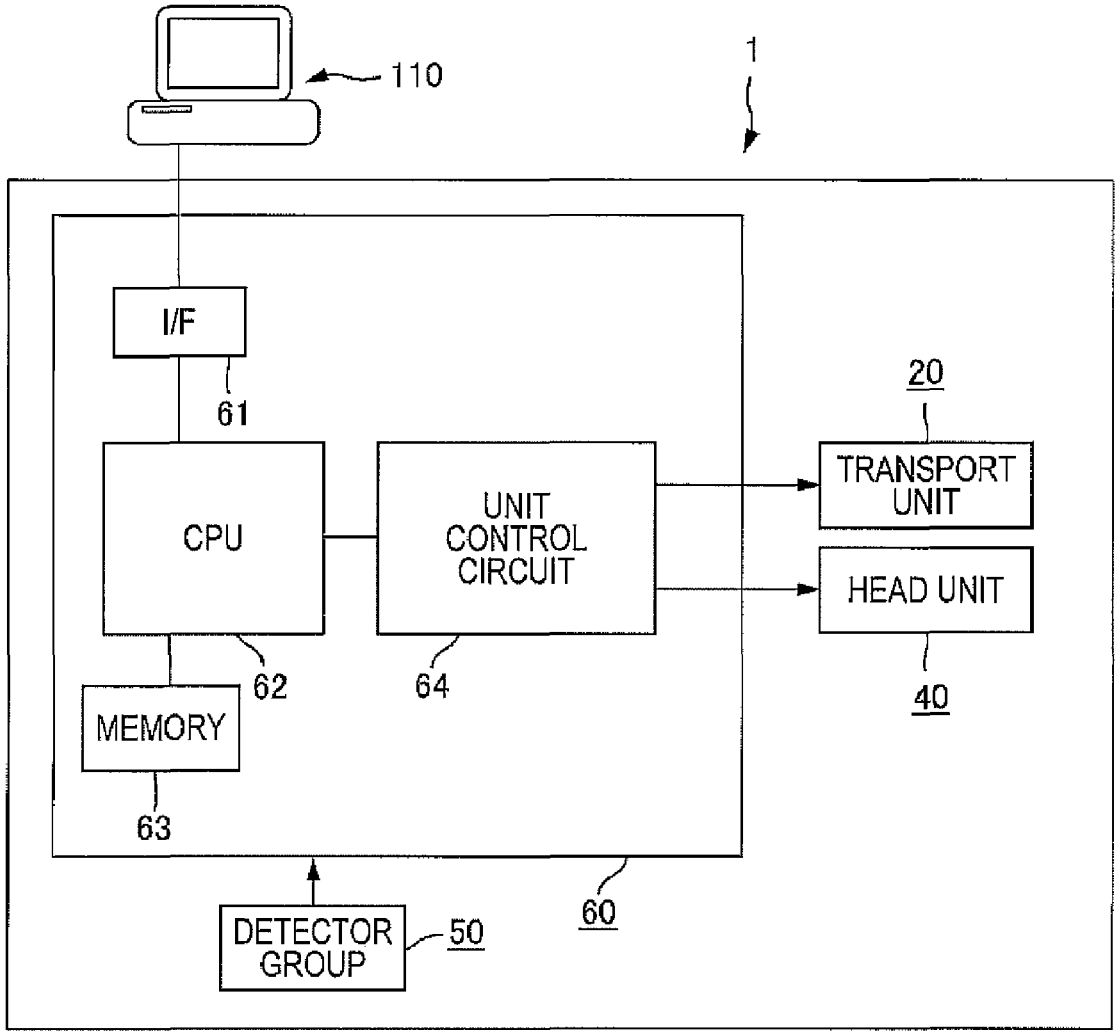
FIG. 2 is a block diagram of a printer according to the present invention.
Figure 3A:
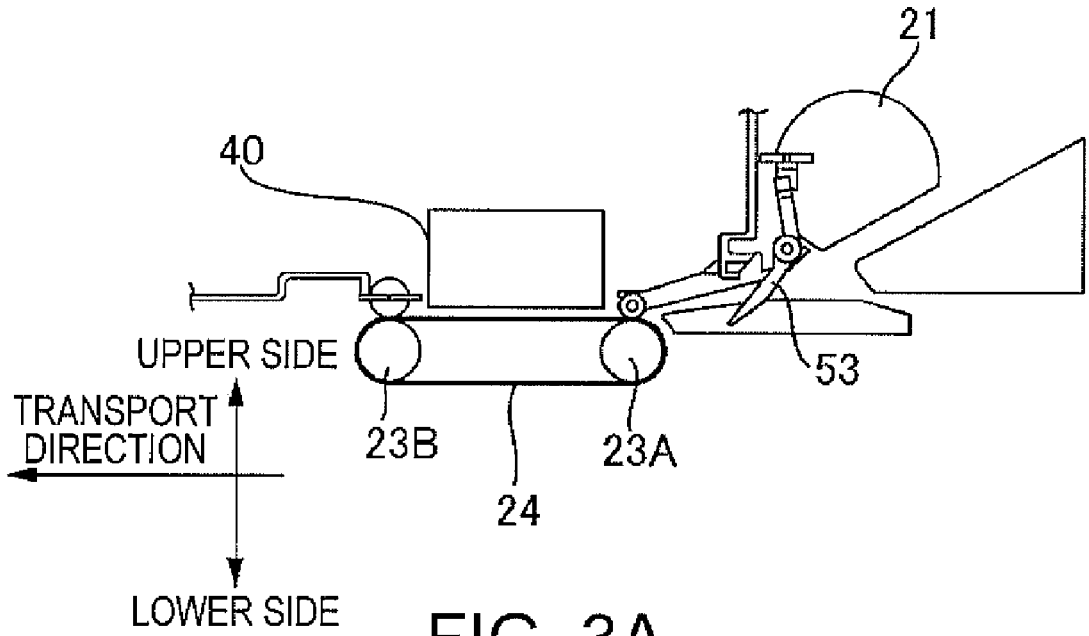
FIG. 3A is a cross-sectional view of the printer.
Figure 3B:
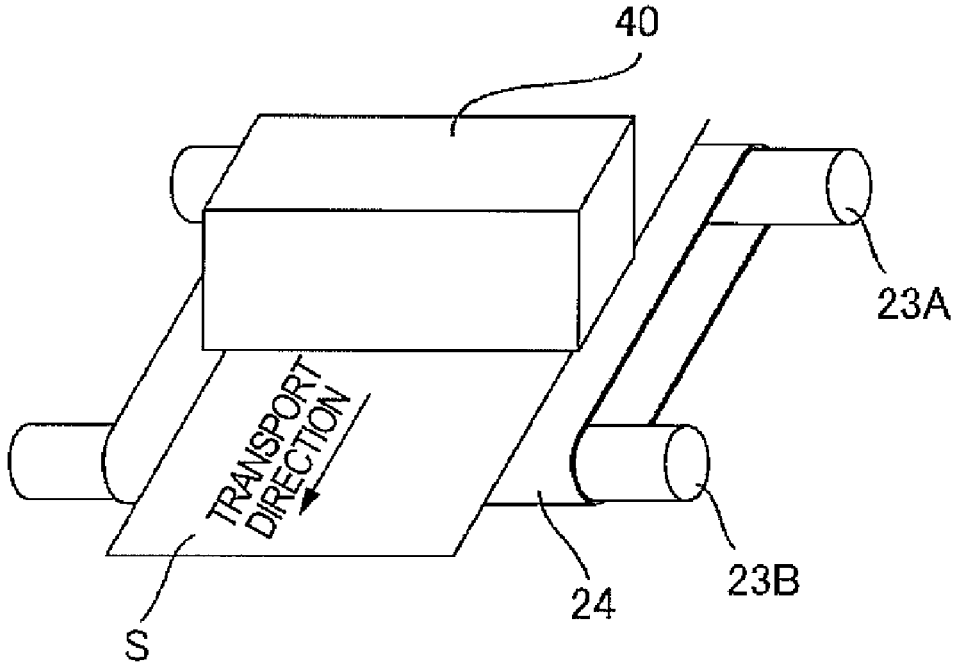
FIG. 3B is a perspective view thereof for explaining a transport process and a dot forming process of the printer.

FIG. 2 is a block diagram of the printer 1. FIG. 3A is a cross-sectional view of the printer 1. FIG. 3B is a perspective view thereof for explaining a transport process and a dot forming process of the printer 1. A basic configuration of a line printer as a printer according to this embodiment of the invention is now explained.

The printer 1 comprises a transport unit 20, head unit 40, a detector group 50, and a controller 60. In response to receiving print data from the computer 110 as an external device, the printer 1 controls the transport unit 20 and the head unit 40 using the controller 60. The controller 60 controls these units based on the print data received from the computer 110 to print an image on paper. Internal conditions of the printer 1 are monitored by the detector group 50, and the detector group 50 outputs the detection results to the controller 60. The controller 60 controls the transport unit 20 and the head unit 40 based on the detection results output from the detector group 50.

The transport unit 20 transports a medium (e.g., paper S) in a predetermined direction (hereinafter referred to as a transport direction). The transport unit 20 has a feed roller 21, a transport motor (not shown), an upstream transport roller 23A, a downstream transport roller 23B, and a belt 24. The feed roller 21 feeds paper inserted in a paper inlet to the inside of the printer. When the transport motor rotates, the upstream transport roller 23A and the downstream transport roller 23B are rotated, and the belt 24 is rotated. The paper S thus fed by the feed roller 21 is transported to a printable area (an area opposed to the head) by the belt 24.

By the belt 24 transporting the paper S, the paper S moves in the transport direction relative to the head unit 40. The paper S, which has passed through the printable area, is ejected to the outside by the belt 24.

During transportation, the paper S is electrostatically absorbed or vacuum-absorbed to the belt 24.

The head unit 40 ejects ink to the paper S. The head unit 40 ejects the ink to the paper S under transportation, thereby forming a dot on the paper S, thus forming an image on the paper S. The printer 1 is a line printer, and the head unit 40 thus can form dots corresponding to the width of the paper at a time. The configuration of the head unit 40 is explained later.

The detector group 50 includes a rotary encoder (not shown), a paper detection sensor 53, and so on. The rotary encoder detects an amount of rotation of the upstream transport roller 23A and the downstream transport roller 23B. The transportation length of the paper S can be detected based on the detection result of the rotary encoder. The paper detection sensor 53 detects a position of a tip of the paper under transportation.

The controller 60 is a control unit (a control section) for performing control of the printer. The controller 60 has an interface section 61, a CPU 62, a memory 63, and a unit control circuit 64. The interface section 61 performs data communications between the computer 110 as an external device and the printer 1. The CPU 62 is an arithmetic processing unit for performing overall control of the printer. The memory 63 provides an area for storing the program for the CPU 62, a working area thereof, and so on, and has a storage component such as a RAM or an EEPROM.

The CPU 62 controls each of the units via the unit control circuit 64 in accordance with the program stored in the memory 63. In particular, the controller 60 controls the transportation operation with the transport unit 20 and the ejection operation (the dot forming operation) of the ink with the head unit 40, thereby performing the dot forming operation in a dot arrangement described later.

Configuration of Head Unit 40

Figure 4A:
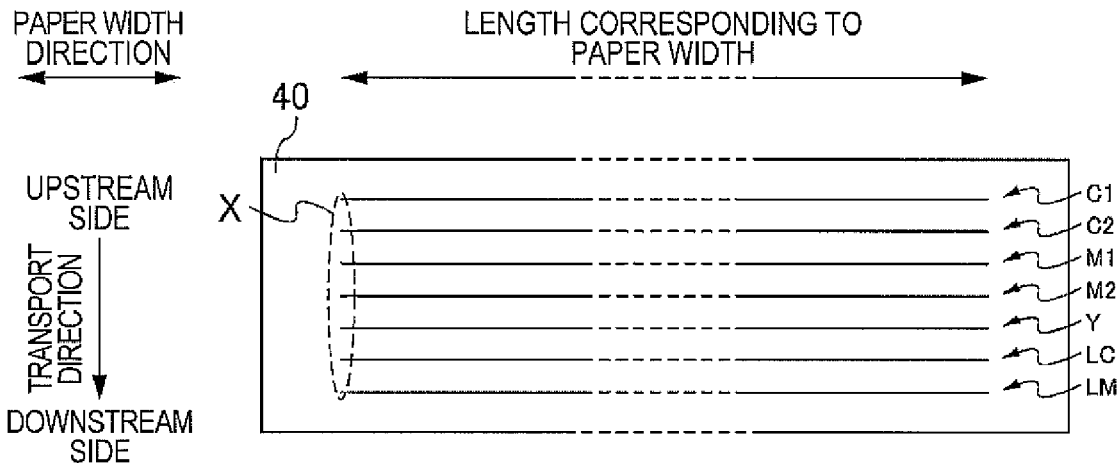
FIG. 4A is an explanatory diagram of an arrangement of a plurality of nozzle lines on a lower surface of a head unit of the printer viewed transparently from above.

FIG. 4A is an explanatory diagram of an arrangement of a plurality of nozzle lines on a lower surface of the head unit 40 viewed transparently from the above. On the lower surface of the head unit 40, there are formed seven nozzle lines.

The seven nozzle lines are first deep cyan nozzle line (C1), second deep cyan nozzle line (C2), first deep magenta nozzle line (M1), second deep magenta nozzle line (M2), yellow nozzle line (Y), light cyan nozzle line (LC), and light magenta nozzle line (LM) disposed in this order from the upstream in the transport direction. The length of each of the nozzle lines in the paper width direction is a length corresponding to the width of an A4 sheet.

Figure 4B:
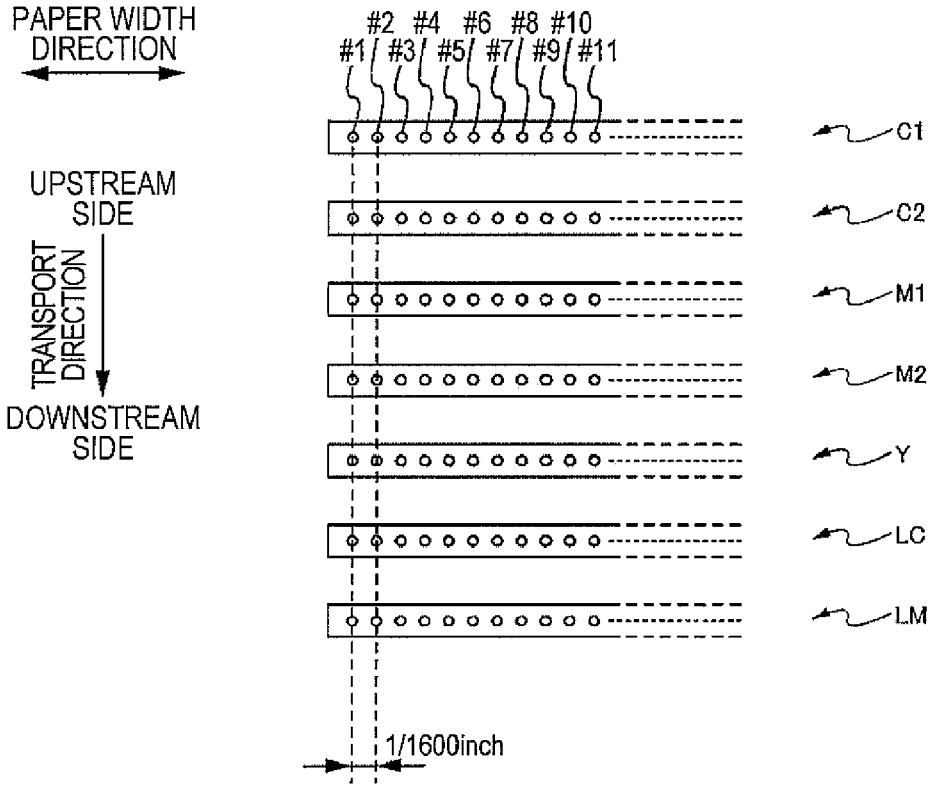
FIG. 4B is an enlarged view of a part X surrounded by a dotted line in FIG. 4A, and an enlarged view of the left end of each of nozzle lines for respective colors.

FIG. 4B is an enlarged view of a part X surrounded by the dotted line in FIG. 4A, and an enlarged view of the left end of each of nozzle lines for respective colors. As shown in FIG. 4B, each of the nozzle lines is composed of a plurality of nozzles aligned along the paper width direction with a predetermined pitch (1/1600 inch in this case). Each of the nozzles is provided with a heater, and the heat generated by the heater causes the ink to be ejected from the nozzle. Here, each of the nozzles in each of the nozzle lines is provided with a number sequentially from the left of FIG. 4B. As shown in FIG. 4B, the positions of the nozzles #1 of respective nozzle lines of the respective colors are aligned in the paper width direction. Further, the positions in the paper width direction of the nozzles with the same numbers other than #1 are also aligned.

FIGS. 5A and 5B are explanatory diagrams of an arrangement of the nozzles.

In order to improve printing resolution, a narrower nozzle pitch is desirable. However, it is sometimes difficult to set a short enough distance between adjacent nozzles because of design limitations. Therefore, as shown in FIG. 5A, the nozzles can be arranged in a zigzag-line manner. The following explanation assumes, for sake of simplicity, that the nozzles are arranged in a line as shown in FIG. 4B.

Further, in the line printer, the nozzle line must have a length corresponding to the paper width. However, it is difficult in some cases to make the length of the nozzle line large because of design limitations. Therefore, as shown in FIG. 5B, a nozzle line with a length corresponding to the paper width can be formed by joining the nozzle lines as extensions. The following explanation assumes, for sake of simplicity, that the nozzles are arranged in a line as shown in FIG. 4B.

Restriction From Cross Talk Between Nozzles

The nozzle line of the present embodiment has the nozzles formed to have a pitch as narrow as 1/1600 inch. If ink is supplied to a number of nozzles in the nozzle line from a common supply channel, ejection of ink from a certain nozzle might influence ejection of ink in an adjacent nozzle. For example, ejection of ink from the nozzle #2 influences ejection of ink in the nozzles #1 and #3. One conceivable reason therefore is that a variation in ink pressure inside the nozzle #2 when ejecting ink from the nozzle #2 is transferred to the nozzles #1 and #3. Another possible reason is that ink supply to the nozzle #2 influences ink supply to the nozzles #1 and #3. This phenomenon of adjacent nozzles influencing each other is referred to as "cross talk between nozzles."

Cross talk between nozzles might cause the amount of ink ejected by a certain nozzle to vary depending on whether or not adjacent nozzle are ejecting ink. For example, an ideal size of ink droplet is ejected from the nozzle #2 when the nozzles #1 and #3 do not eject ink, whereas only a small size of ink droplet might be ejected from the nozzle #2 when the nozzles #1 and #3 eject ink.

Therefore, in the present embodiment, when a certain nozzle ejects the, adjacent nozzles are restricted from ejecting ink.

Dot Forming Method of First Embodiment

Cyan

Figure 7A:
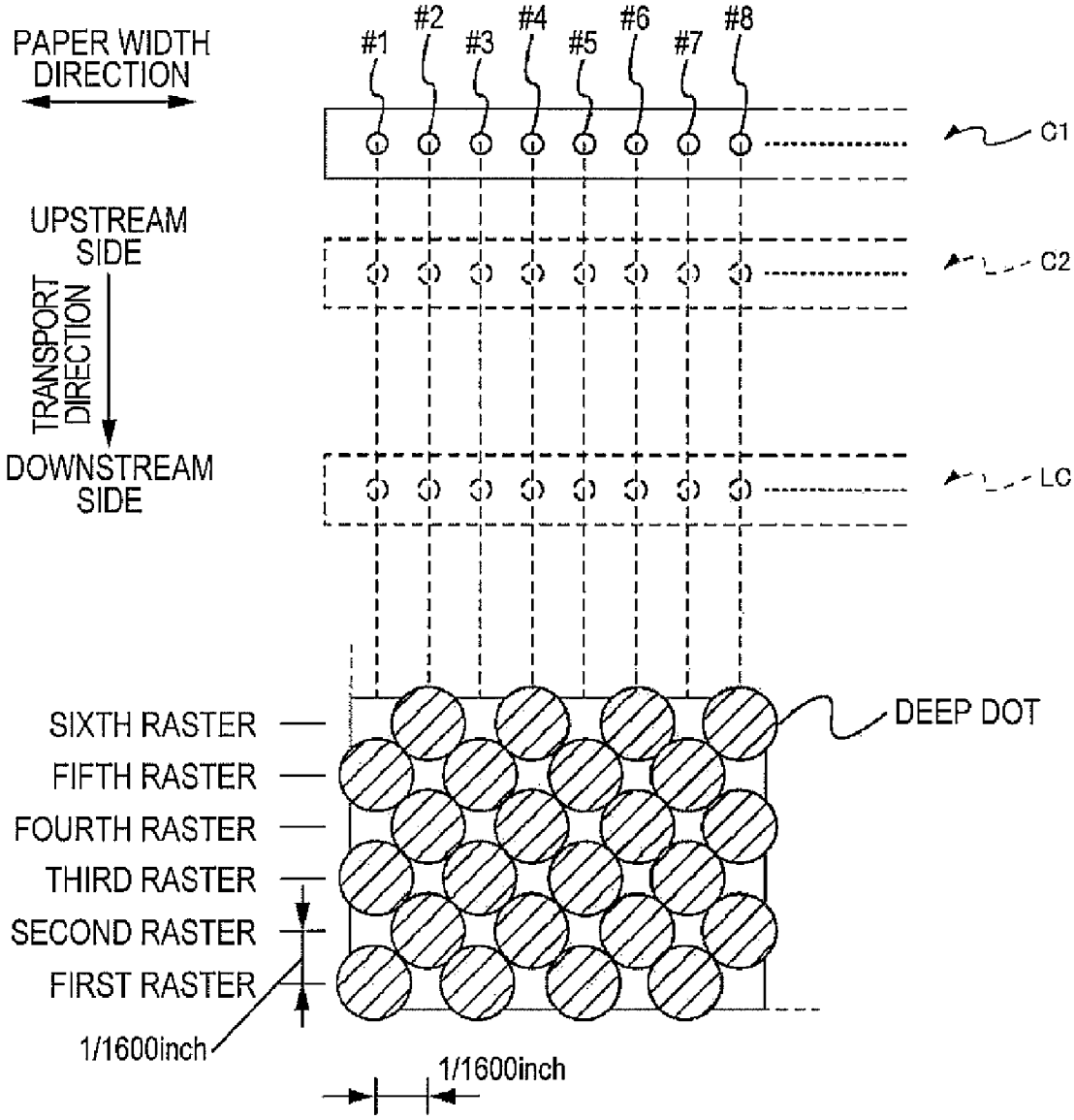
FIG. 7A is an explanatory diagram of a deep dot forming method with a first deep cyan nozzle line in the first embodiment.
Figure 7B:
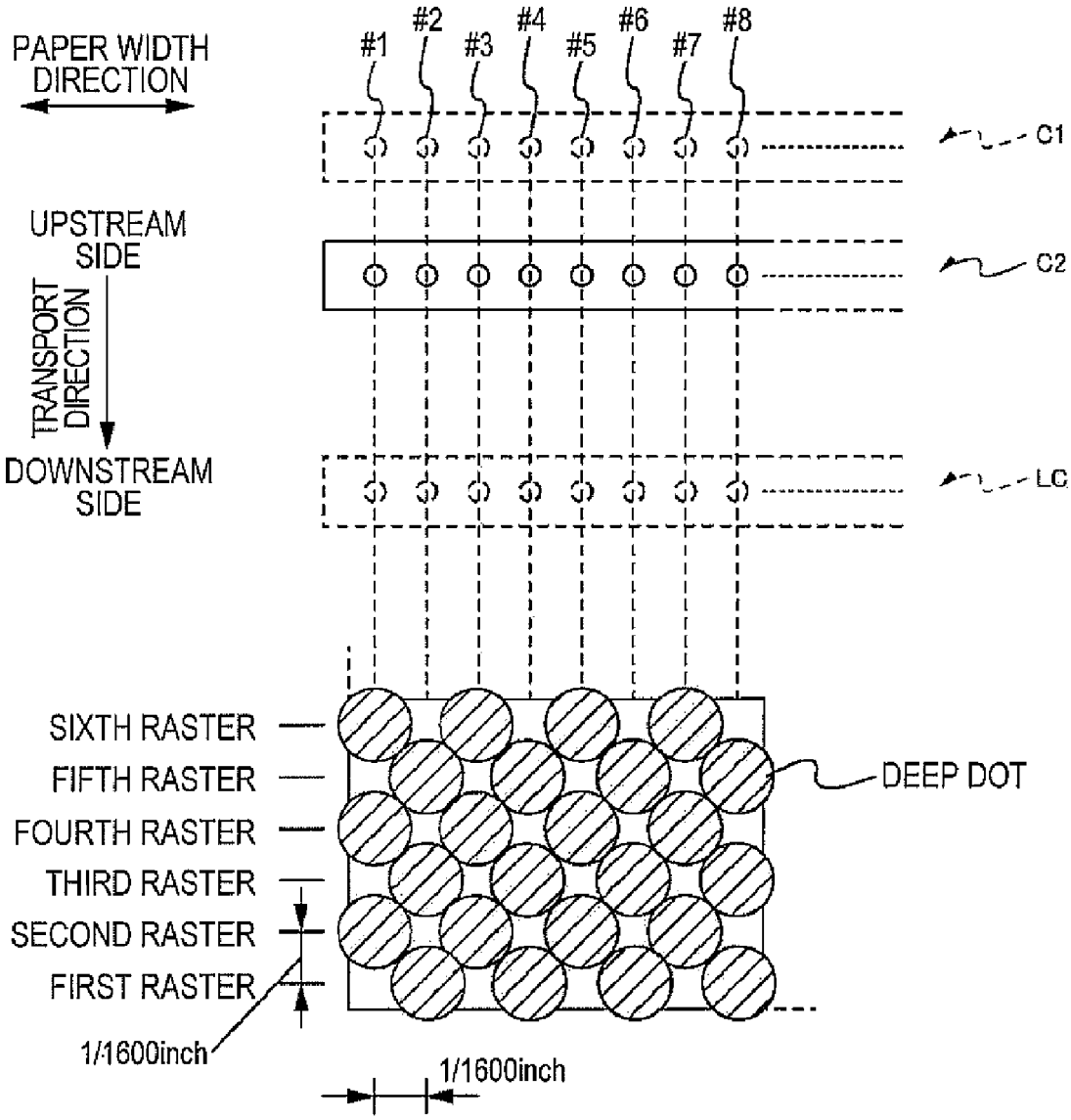
FIG. 7B is an explanatory diagram of a deep dot forming method with a second deep cyan nozzle line in the first embodiment.
Figure 7C:
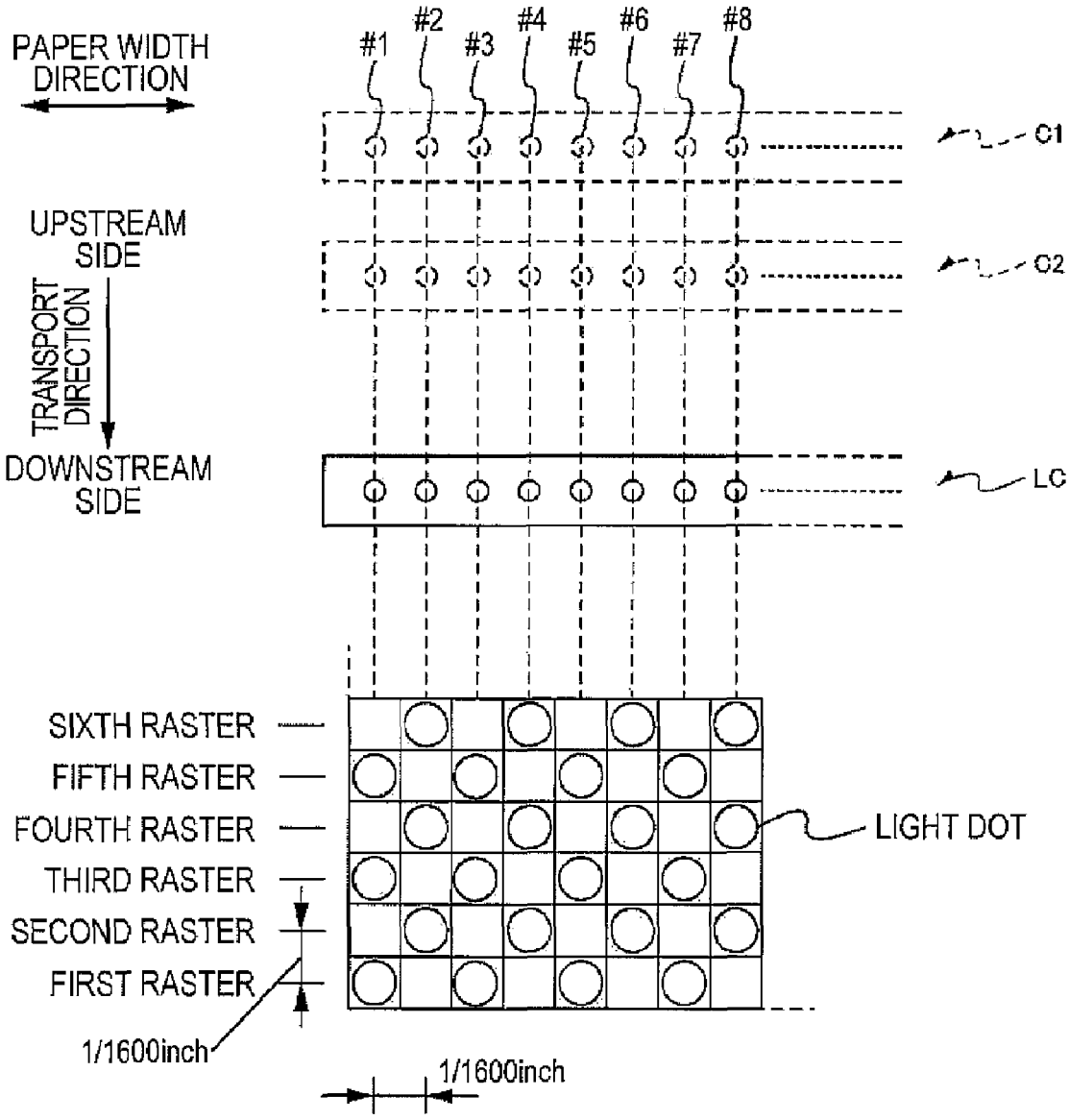
FIG. 7C is an explanatory diagram of a light dot forming method with a light cyan nozzle line in the first embodiment.

FIG. 6 is an explanatory diagram of a dot forming method according to a first embodiment of the invention. FIG. 7A is an explanatory diagram of a deep dot forming method with a first deep cyan nozzle line in the first embodiment. FIG. 7B is an explanatory diagram of a deep dot forming method with a second deep cyan nozzle line in the first embodiment. FIG. 7C is an explanatory diagram of a light dot forming method with a light cyan nozzle line in the first embodiment.

Here, attention is focused on cyan, and description for nozzle lines with other colors is omitted. Further, in the following explanation, descriptions of "cyan" are also omitted if there is no particular necessity for the description. Thus, "a deep cyan nozzle line" may be referred to as "a deep nozzle line," for example.

on the upper sides of the drawings, the first deep nozzle line (C1), the second nozzle line (C2), and the light nozzle line (LC) are illustrated. As shown in the drawings, in the present embodiment, the number of light nozzle lines is smaller than the number of deep nozzle lines.

On the lower sides of the drawings, dots provided to pixels disposed in a square lattice are illustrated. The dots with hatching are deep dots formed from deep ink ejected from the deep nozzle lines. The dots without hatching are light dots formed from light ink ejected from the light nozzle line. As described later, since the deep dots and the light dots are formed in an overlapping manner, the light dots are illustrated in FIG. 6 with outline circles on the deep dots with hatching.

Here, for the sake of convenience of explaining the arrangement of the dots, the drawing shows the condition provided with the largest number of dots. Therefore, when the dots are formed as shown in the drawing, the gray-scale (depth) of cyan represented by the deep cyan dots and the light cyan dots becomes the deepest. It should be noted that, under ordinary circumstances, the gray-scale of cyan varies in accordance with an image to be printed, and some dots are eliminated in accordance with the gray-scale of cyan.

Firstly, formation of dots (a raster) aligned in the paper width direction will be explained.

As shown in FIG. 7A, when the first deep nozzle line (C1) is opposed to a raster with an odd number, deep ink is ejected from nozzles with odd numbers in the first deep nozzle line, and deep dots are thus provided to the odd-numbered pixels. For example, when the first raster is opposed to the first deep nozzle line (C1), deep ink is ejected from the odd-numbered nozzles #1, #3, #5, . . . , to form deep dots on the respective odd-numbered pixels. Further, when the first deep nozzle line (C1) is opposed to a raster with an even number, deep ink is ejected from the nozzles with even numbers in the first deep nozzle line, and deep dots are thus provided to the even-numbered pixels. For example, when the pixels in the second raster are opposed to the first deep nozzle line (C1), deep ink is ejected from the even-numbered nozzles #2, #4, #6, . . . , to form deep dots on the respective even-numbered pixels. As described above, because ink is ejected from either the odd-numbered or even-numbered nozzles, and the other nozzles do not eject ink, ink is not ejected from the adjacent nozzles, and the problem of cross talk between the nozzles is thus eliminated.

As shown in FIG. 7B, when the second deep nozzle line (C2) is opposed to a raster with an odd number, deep ink is ejected from nozzles with even numbers in the second deep nozzle line, and deep dots are thus provided to the even-numbered pixels. For example, when the first raster is opposed to the second deep nozzle line (C2), deep ink is ejected from the even-numbered nozzles #2, #4, #6, . . . , to form deep dots on the respective even-numbered pixels. Further, when the second deep nozzle line (C2) is opposed to a raster with an even number, deep ink is ejected from nozzles with odd numbers in the second deep nozzle line, and deep dots are thus provided to the odd-numbered pixels. For example, when the pixels in the second raster are opposed to the second deep nozzle line (C2) deep ink is ejected from the odd-numbered nozzles #1, #3, #5, . . . , to form deep dots on the respective odd-numbered pixels. As described above, because ink is ejected from either the even-numbered or odd-numbered nozzles, and the other nozzles do not eject ink, ink is not ejected from the adjacent nozzles, and the problem of cross talk between the nozzles is thus eliminated.

As shown in FIG. 7C, when the light nozzle line (LC) is opposed to a raster with an odd number, light ink is ejected from nozzles with odd numbers in the light nozzle line, and light dots are thus provided to the odd-numbered pixels. For example, when the pixels in the first raster are opposed to the light nozzle line (LC), light ink is ejected from the odd-numbered nozzles #1, #3, #5, . . . , to form light dots on the respective odd-numbered pixels. Further, when the light nozzle line (LC) is opposed to a raster with an even number, light ink is ejected from the nozzles with even numbers in the light nozzle line, thus light dots are provided to the even-numbered pixels. For example, when the pixels in the second raster are opposed to the light nozzle line (LC), light ink is ejected from the even-numbered nozzles #2, #4, #6, . . . , to form light dots on the respective even-numbered pixels. In other words, the light nozzle line (LC) forms light dots at the same positions as those of the deep dots formed by the first deep nozzle line (C1). Also in the light nozzle line, because ink is ejected from either the odd-numbered or even-numbered nozzles, and the other nozzles do not eject ink, ink is not ejected from the adjacent nozzles, and the problem of cross talk between the nozzles is thus eliminated.

Here, attention is focused on deep dots aligned in the paper width direction. When forming dots of a certain raster (the dots aligned in the paper width direction), on one hand, the first deep nozzle line (C1) forms deep dots every other pixel in the paper width direction by setting either the even-numbered or odd-numbered nozzles to be in a nonuse state, and on the other hand, the second deep nozzle line (C2) forms deep dots every other pixel in the paper width direction by setting either the odd-numbered or even-numbered nozzles to be in a non-use state so that deep dots are formed between the deep dots formed every other pixel in the paper width direction by the first deep nozzle line. Thus, the deep dots formed by the first nozzle line (C1) and the deep dots formed by the second deep nozzle line (C2) are aligned alternately in the paper width direction, and deep ink is thus applied without a gap. If the deep dots formed by the first deep nozzle line (C1) and the deep dots formed by the second deep nozzle line (C2) are formed overlapping each other at the same pixels, a gap where no deep ink is applied is caused, and even in the case in which painting with all cyan is required, the basic color of the paper can easily be viewed through the gap.

Focusing attention on the relationship between deep dots and light dots aligned in the paper width direction, as understood from FIGS. 7A and 7C, the light dots are formed to overlap the deep dots formed by the first deep nozzle line (C1). The reason therefore is as explained below. Since the first deep nozzle line (C1) is disposed upstream in the transport direction from the second deep nozzle line (C2), the first deep nozzle line (C1) forms deep dots before the second deep nozzle line (C2). Therefore, when the light nozzle line is opposed to the pixels provided with deep dots, deep dots formed by the first deep nozzle line (C1) are absorbed by the paper and dried better than deep dots formed by the second deep nozzle line (C2). Taking the drying condition of such deep dots into consideration, in the present embodiment, light dots are formed to overlap the deep dots formed by the first deep nozzle line (C1). It should be noted that if light dots are formed to overlap deep dots formed by the second deep nozzle line (C2) instead of deep dots formed by the first deep nozzle line (C1), the ink easily runs.

Formation of dots aligned in the transport direction is now explained.

As shown in FIG. 7A, nozzles with odd numbers in the first deep nozzle line (C1) eject deep ink every time the nozzles become opposed to a raster with an odd number to form deep dots on every other pixel in the transport direction. For example, the nozzle #1 ejects deep ink every time it becomes opposed to the first, third, fifth, . . . raster to form deep dots on every other pixel in the transport direction. As described above, nozzles with odd numbers in the first deep nozzle line (C1) provide deep dots to the pixels in a raster with an odd number, and do not provide the dots to pixels in a raster with an even number to which the nozzles become subsequently opposed. Further, nozzles with even numbers in the first deep nozzle line (C1) eject deep ink every time the nozzles become opposed to a raster with an even number to form deep dots on every other pixel in the transport direction. For example, the nozzle #2 ejects deep ink every time it becomes opposed to the second, fourth, sixth, . . . raster to form deep dots on every other pixel in the transport direction. As described above, nozzles with even numbers in the first deep nozzle line (C1) provide deep dots to pixels in a raster with an even number, and do not provide the dots to pixels in a raster with an odd number to which the nozzles become subsequently opposed.

As shown in FIG. 7B, nozzles with odd numbers in the second deep nozzle line (C2) eject deep ink every time the nozzles become opposed to a raster with an even number to form deep dots on every other pixel in the transport direction. For example, the nozzle #1 ejects deep ink every time it becomes opposed to the second, fourth, sixth, . . . raster to form deep dots on every other pixel in the transport direction. As described above, nozzles with odd numbers in the second deep nozzle line (C2) provide deep dots to pixels in a raster with an even number, and do not provide the dots to pixels in a raster with an odd number to which the nozzles become subsequently opposed. Further, nozzles with odd numbers in the second deep nozzle line (C2) eject deep ink every time the nozzles become opposed to a raster with an odd number to form deep dots on every other pixel in the transport direction. For example, the nozzle #2 ejects deep ink every time it becomes opposed to the first, third, fifth, . . . raster to form deep dots on every other pixel in the transport direction. As described above, nozzles with even numbers in the second deep nozzle line (C2) provide deep dots to pixels in a raster with an odd number, and do not provide the dots to pixels in a raster with an even number to which the nozzles become subsequently opposed.

As shown in FIG. 7C, nozzles with odd numbers in the light nozzle line (LC) eject light ink every time the nozzles become opposed to a raster with an odd number to form light dots on every other pixel in the transport direction. For example, the nozzle #1 ejects light ink every time it becomes opposed to the first, third, fifth, . . . raster to form light dots on every other pixel in the transport direction. As described above, nozzles with odd numbers provide light dots to pixels in a raster with an odd number, and do not provide the dots to pixels in a raster with an even number to which the nozzles become subsequently opposed. Further, nozzles with even numbers in the light nozzle line (LC) eject light ink every time the nozzles become opposed to a raster with an even number to form light dots on every other pixel in the transport direction. For example, the nozzle #2 ejects light ink every time it becomes opposed to the second, fourth, sixth, . . . raster to form light dots on every other pixel in the transport direction. In other words, the light nozzle line (LC) forms light dots at the same positions as those of the deep dots formed by the first deep nozzle line (C1). As described above, nozzles with even numbers provide light dots to pixels in a raster with an even number, and do not provide the dots to pixels in a raster with an odd number to which the nozzles become subsequently opposed.

Attention is now focused on deep dots aligned in the transport direction. When forming dots on pixels aligned in the transport direction, the first deep nozzle line (C1) forms deep dots every other pixel in the transport direction, while the second deep nozzle line (C2) forms deep dots on every other pixel in the transport direction so that deep dots are formed between the deep dots formed by the first deep nozzle line every other pixel in the transport direction.

Thus, deep dots formed by the first nozzle line (C1) and deep dots formed by the second deep nozzle line (C2) are aligned alternately in the transport direction, and deep ink is thus applied without a gap. If deep dots formed by the first deep nozzle line (C1) and deep dots formed by the second deep nozzle line (C2) are formed overlapping each other at the same pixels, a gap where no deep ink is applied is caused, and even in the case in which painting with all cyan is required, the basic color of the paper can easily be viewed through the gap.

Focusing attention on the relationship between deep dots and light dots aligned in the transport direction, as understood from FIGS. 7A and 7C, light dots are formed to overlap deep dots formed by the first deep nozzle line (C1). The reason thereforee is that, when the light nozzle line is opposed to pixels provided with deep dots, deep dots formed by the first deep nozzle line (C1) are absorbed by the paper and dried better than deep dots formed by the second deep nozzle line (C2).

Incidentally, there is a design limitation in the cycle length (an ejection cycle) by which ink droplets can continuously be ejected from a nozzle. If dots are formed on pixels continuing in the transport direction, the paper can only be transported a distance corresponding to one pixel during the ejection cycle, which lowers the transport speed, and thus the print speed is lowered. In contrast, in the first embodiment, since each of the nozzles forms dots on every other pixel in the transport direction, the paper can be transported a distance corresponding to two pixels during the ejection cycle, and the print speed is thus increased.

According to the first embodiment described hereinabove, deep dots are formed in a checkerboard pattern by the first deep nozzle line (C1) (see FIG. 7A), and deep dots are formed in a checkerboard pattern by the second deep nozzle line (C2) (see FIG. 7B) so that the dots are formed between the deep dots formed by the first deep nozzle line. As a result, deep dots are formed on all of the pixels. In contrast, the light dots are formed in a checkerboard pattern only by a single light nozzle line (see FIG. 7C), and the light dots are formed on only a part of the pixels (see FIG. 6). The reason thereforee is explained below.

The light dots are fundamentally formed for the purpose of making it possible to represent a faint color with a smooth gray-scale. Therefore, it is enough for light dots to be thinly formed on an area of the faint color in the print image, and there is no need for forming light dots thickly. In the case in which a color density (neutral color) substantially the same as the case of forming the light dots on all of the pixels is represented, a color density similar thereto can be represented by thinly forming deep dots instead of light dots (or alternatively, mixing light dots and deep dots). In other words, the necessity of disposing light dots at a high density is small. In contrast, deep dots are used for representing deep color, and in particular for representing a deep gray-scale by filling the pixels therewith. If a gap to which no deep ink is applied is generated, the basic color of the paper can easily be viewed, thus a deep enough gray-scale can hardly be represented. Further, when printing characters, the character section has deep color, and deep dots are mainly used therefore. Further, in order to make edges of characters conspicuous, deep dots must be disposed at a high resolution. In other words, the need to dispose deep dots at a high density is large. For such reasons, deep dots are formed on all of the pixels while light dots are formed in a checkerboard pattern.

Further, since light dots only need to be formed in a checkerboard pattern, and do not need to be formed on all of the pixels, the number of light nozzle lines can be set smaller than that of the deep nozzle lines. Therefore, according to the first embodiment, since the number of nozzle lines of the head unit can be set smaller than in the case of providing the same number of light nozzle lines as that of deep nozzle lines, the manufacturing cost is reduced.

It should be noted that the size of the deep dots is larger than that of the light dots in the first embodiment. The reason therefore is explained below.

The light dots are fundamentally formed for the purpose of making it possible to represent a faint color with a smooth gray-scale. Therefore, if the light dots become larger dots, granularity becomes noticeable in an area with a faint color in the print image, which is not preferable. Therefore, a smaller light dot is preferable. In contrast, if the size of the deep dots is also reduced, a gap to which no deep ink is applied is caused, and even in the case in which painting with all cyan is required, the basic color of the paper can easily be viewed through the gap. Therefore, a deep dot with a larger size than that of a light dot is more advantageous than a deep dot with the same size as that of a light dot. For this reason, the size of the deep dots is set larger than that of the light dots in the first embodiment.

Ink With Other Colors Than Cyan

Regarding magenta, two deep nozzle lines (M1, M2) and a single light nozzle line (LM) are also provided (see FIGS. 4A and 4B). Therefore, by forming dots with the two deep nozzle lines (M1, M2) of magenta and the single light nozzle line (LM) thereof in the same manner as with cyan described above, the same advantages are obtained. According to this configuration, since the number of nozzle lines of the head unit can be set smaller than in the case of providing the same number of light magenta nozzle lines as the number of deep magenta nozzle lines, the manufacturing cost is reduced.

Pixels on which light dots of magenta are formed and pixels on which light dots of cyan are formed are preferably different from each other. Specifically, light dots of cyan are preferably formed in a checkerboard pattern, and light dots of magenta are also formed in a checkerboard pattern so that they are formed between the light dots of cyan thus formed in a checkerboard pattern. Thus, light dots of cyan and light dots of magenta are disposed in a dispersed manner in an area with a faint color in the print image, and consequently, the granularity of the print image is reduced and image quality is improved.

Regarding yellow, ejection of deep-colored ink and light-colored ink having colors different in depth from each other is not adopted. The reason therefore is that the problem of granularity hardly arises because yellow dots are not so conspicuous as those of cyan or magenta (in contrast, light ink is prepared for cyan or magenta because the dots thereof are so conspicuous as to cause the problem of granularity). Therefore, only one nozzle line is prepared for ejecting yellow ink (see FIGS. 4A and 4B).

The yellow nozzle line (Y) forms the dots in a checkerboard pattern. Thus, ejection of ink from a nozzle adjacent to a certain nozzle that ejects ink is prevented, and the problem of cross talk between the nozzles is eliminated. Further, since each nozzle forms dots on every other pixel in the transport direction, the paper can be transported a distance corresponding to two pixels during the ejection cycle, thus print speed is thus increased.

Second Embodiment

Figure 8:
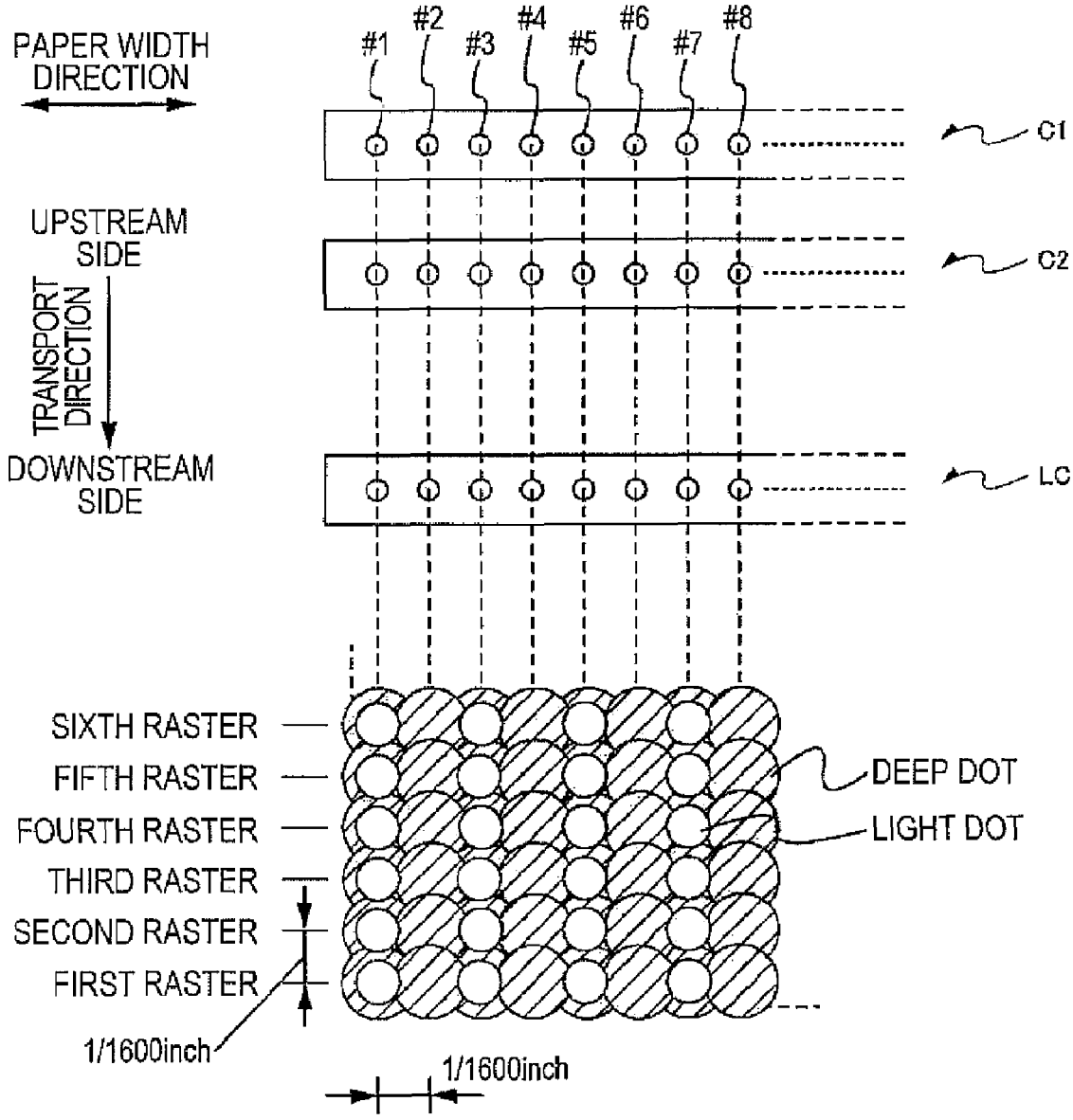
FIG. 8 is an explanatory diagram of a dot forming method according to a second embodiment of the invention.
Figure 9A:
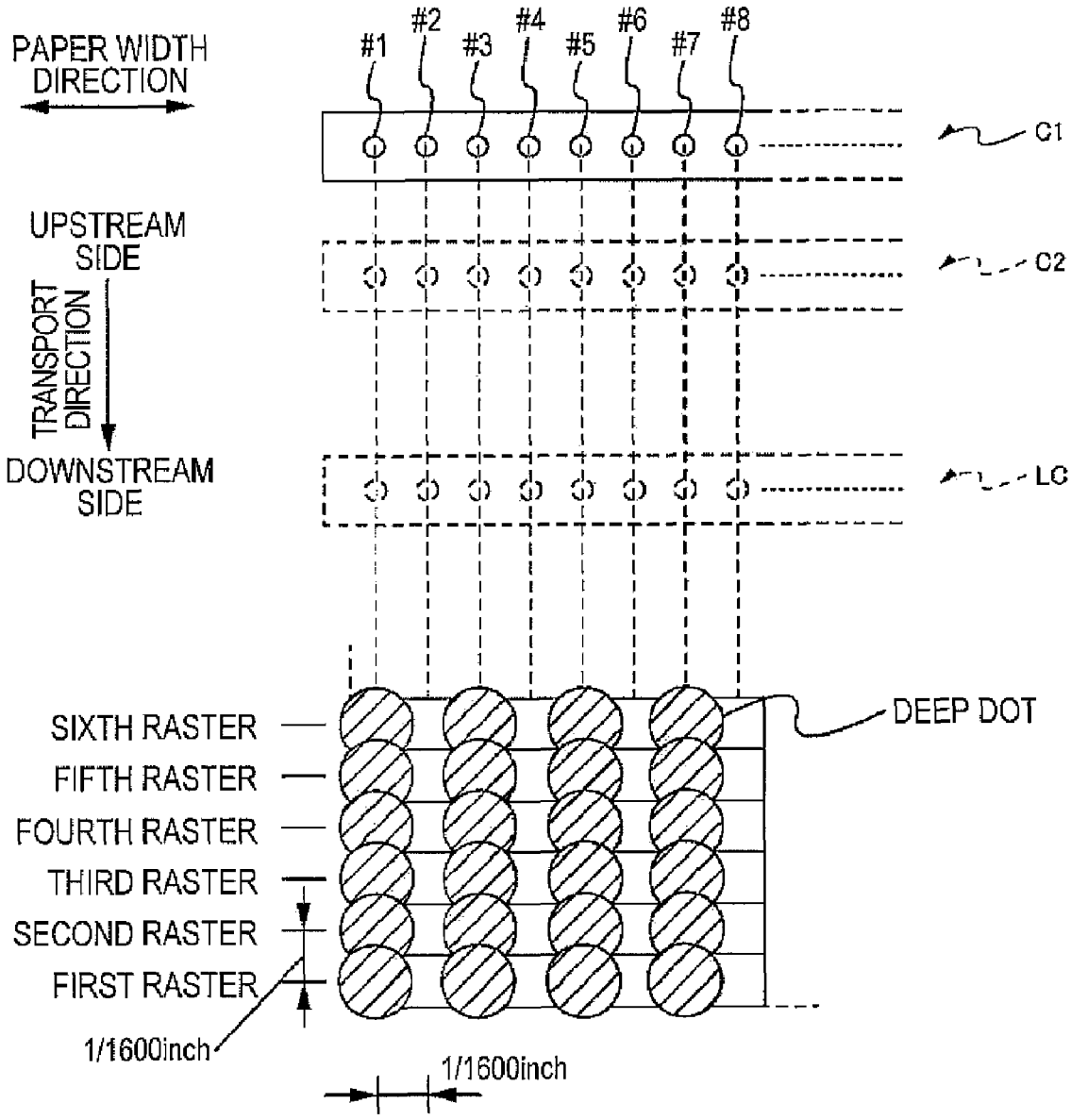
FIG. 9A is an explanatory diagram of a deep dot forming method with a first deep cyan nozzle line in the second embodiment.
Figure 9B:
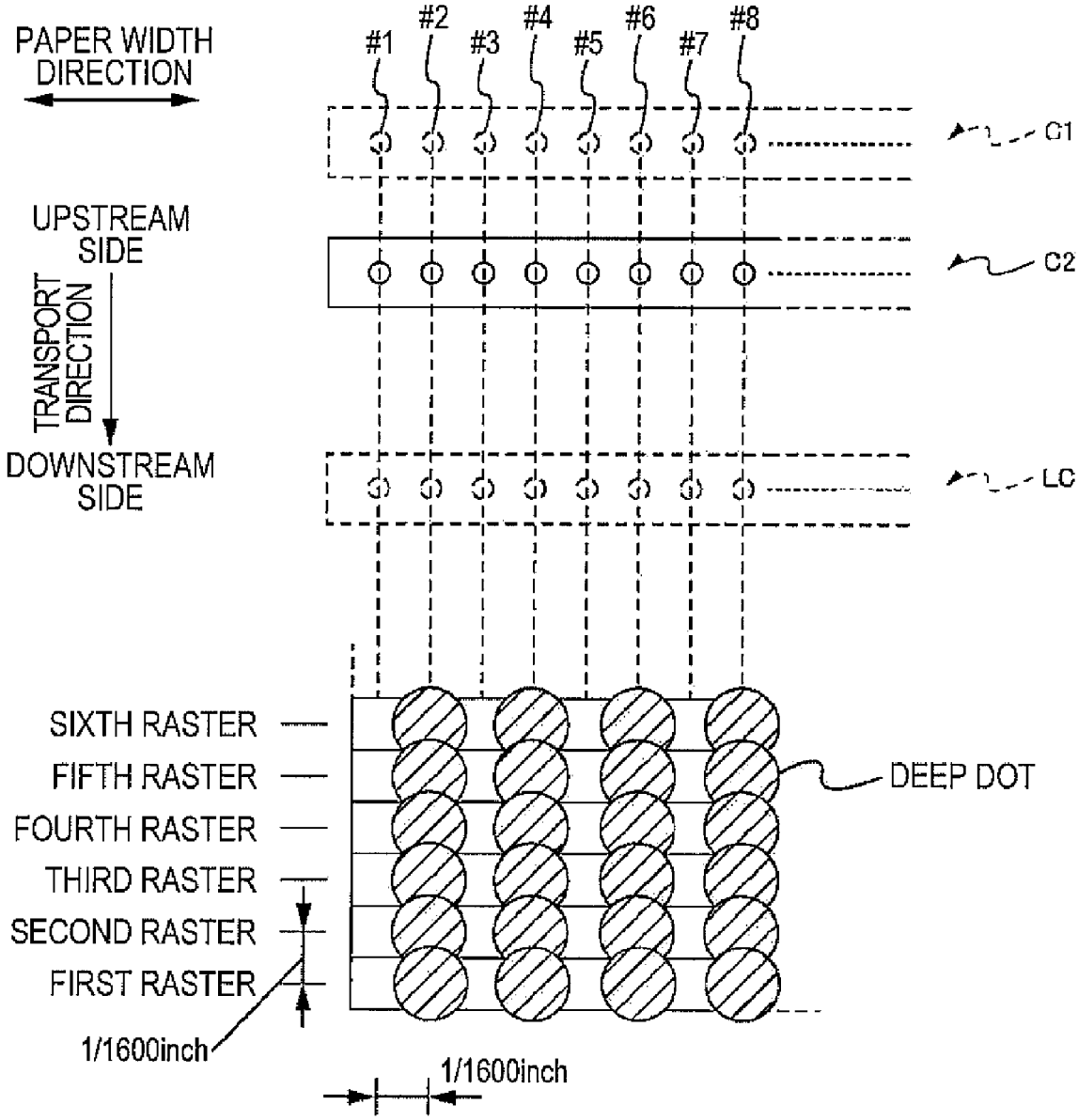
FIG. 9B is an explanatory diagram of a deep dot forming method with a second deep cyan nozzle line in the second embodiment.
Figure 9C:
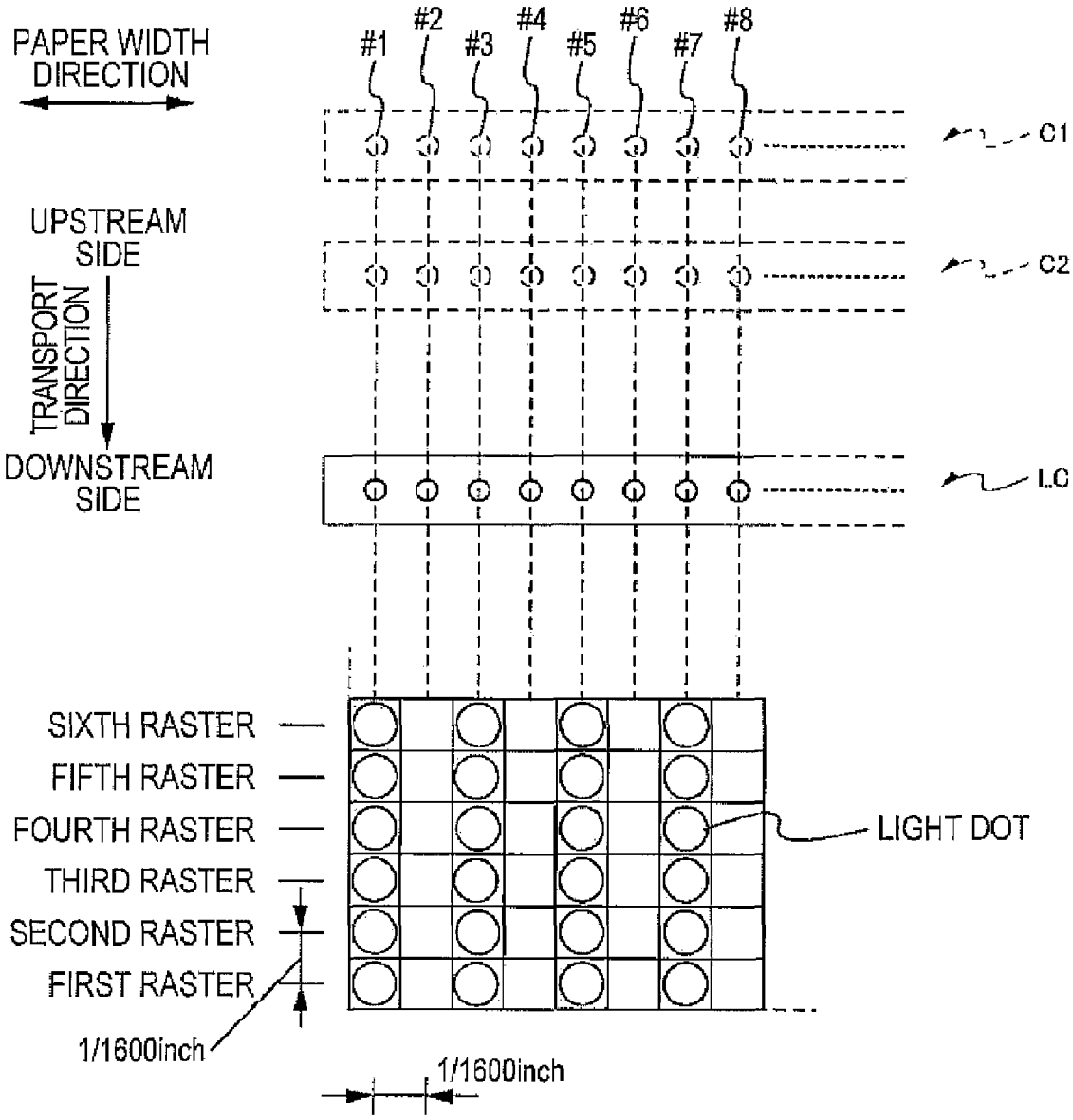
FIG. 9C is an explanatory diagram of a light dot forming method with a light cyan nozzle line in the second embodiment.

FIG. 8 is an explanatory diagram of a dot forming method according to a second embodiment of the invention. FIG. 9A is an explanatory diagram of a deep dot forming method with a first deep cyan nozzle line in the second embodiment. FIG. 9B is an explanatory diagram of a deep dot forming method with a second deep cyan nozzle line in the second embodiment. FIG. 9C is an explanatory diagram of a light dot forming method with a light cyan nozzle line in the second embodiment.

As shown in FIG. 9A, when the first deep nozzle line (C1) is opposed to each raster, deep ink is ejected from nozzles with odd numbers in the first deep nozzle line, and deep dots are thus provided to the odd-numbered pixels. As shown in FIG. 9B, when the second deep nozzle line (C2) is opposed to each raster, deep ink is ejected from nozzles with even numbers in the second deep nozzle line, and deep dots are thus provided to the even-numbered pixels. Further, as shown in FIG. 9C, when the light nozzle line (LC) is opposed to each raster, light ink is ejected from the nozzles with odd numbers in the light nozzle line, and light dots are thus provided to the odd-numbered pixels. As described above, since in each of the nozzle lines, ink is ejected from either the odd-numbered or even-numbered nozzles, and the other nozzles do not eject ink, the problem of cross talk between nozzles is eliminated.

Also in the second embodiment, there is no need for forming light dots on all of the pixels, and consequently, the number of light nozzle lines can be set smaller than the number of deep nozzle lines. Therefore, according also to the second embodiment, since the number of nozzle lines of the head unit can be set smaller than in the case of providing the same number of light nozzle lines as that of deep nozzle lines, the manufacturing cost is reduced.

In the second embodiment, the first and second deep nozzle lines form dots on pixels disposed continuously in the transport direction. Further, the light nozzle line also forms dots on pixels disposed continuously in the transport direction. Therefore, since the paper can be transported a length corresponding to only one pixel during the ejection cycle in the second embodiment, the transport speed is lowered in comparison with the first embodiment, and consequently, the printing speed is lowered.

Third Embodiment

Figure 10:
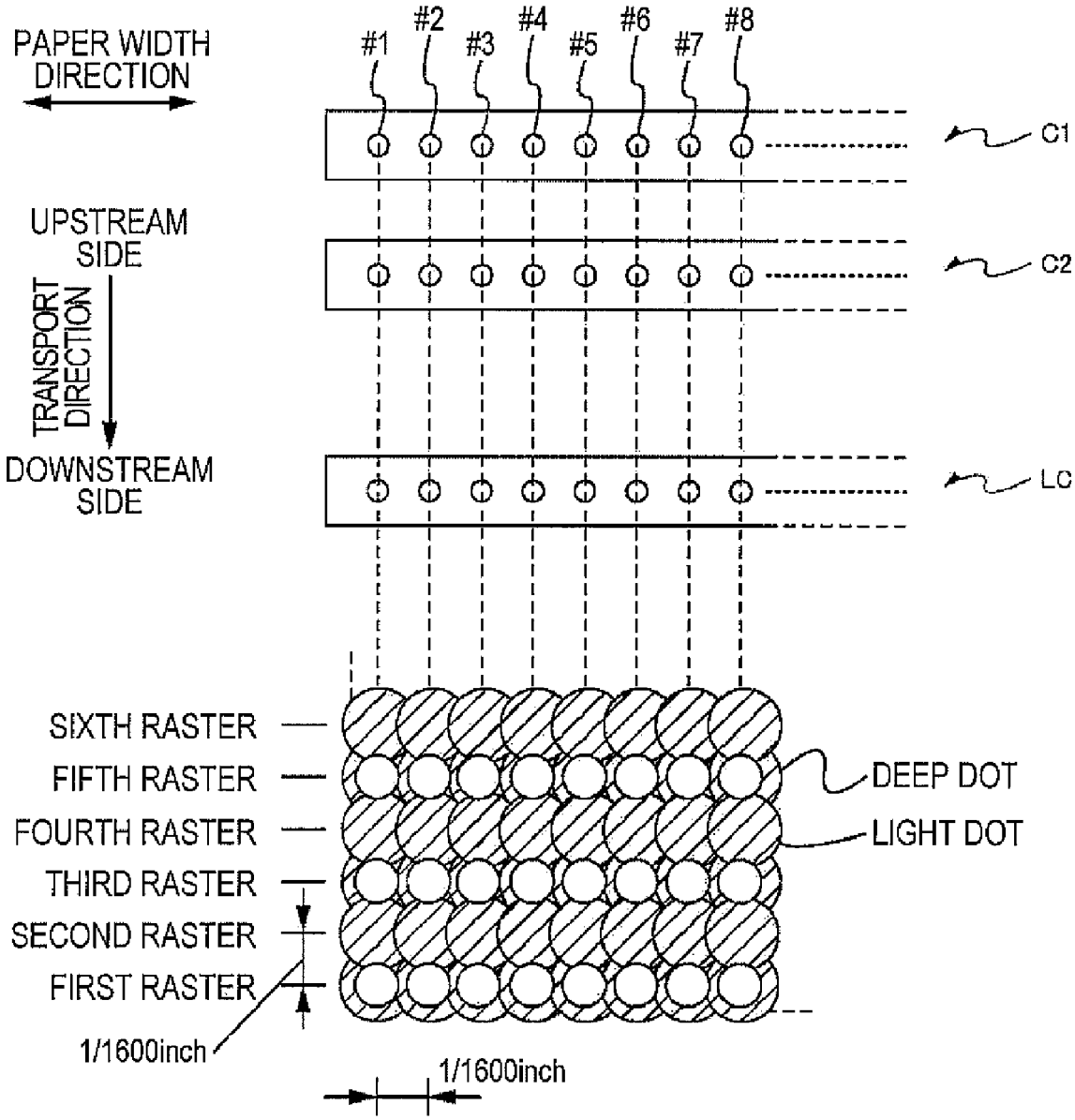
FIG. 10 is an explanatory diagram of a dot forming method according to a third embodiment of the invention.
Figure 11A:
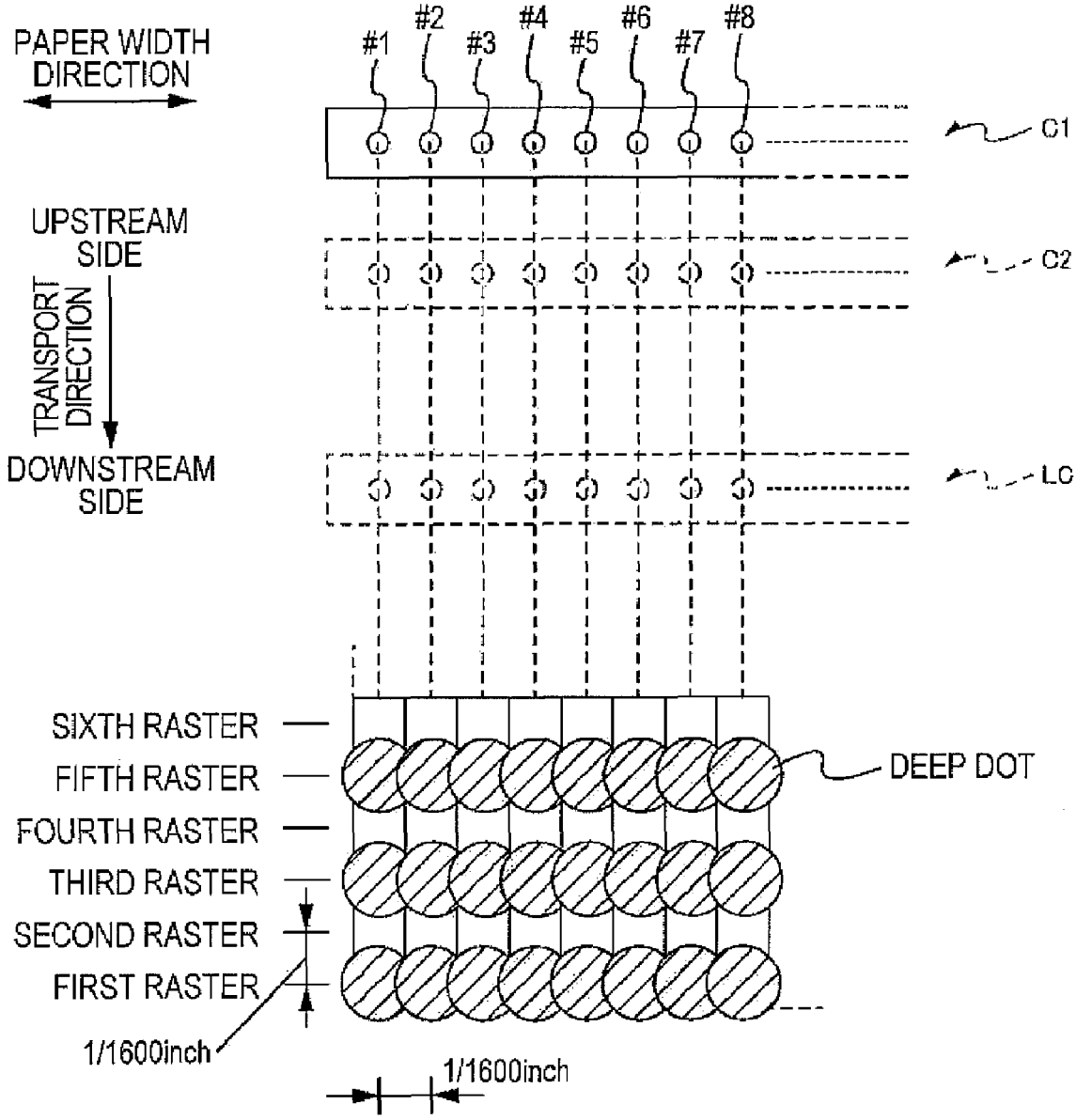
FIG. 11A is an explanatory diagram of a deep dot forming method with a first deep cyan nozzle line in the third embodiment.
Figure 11B:
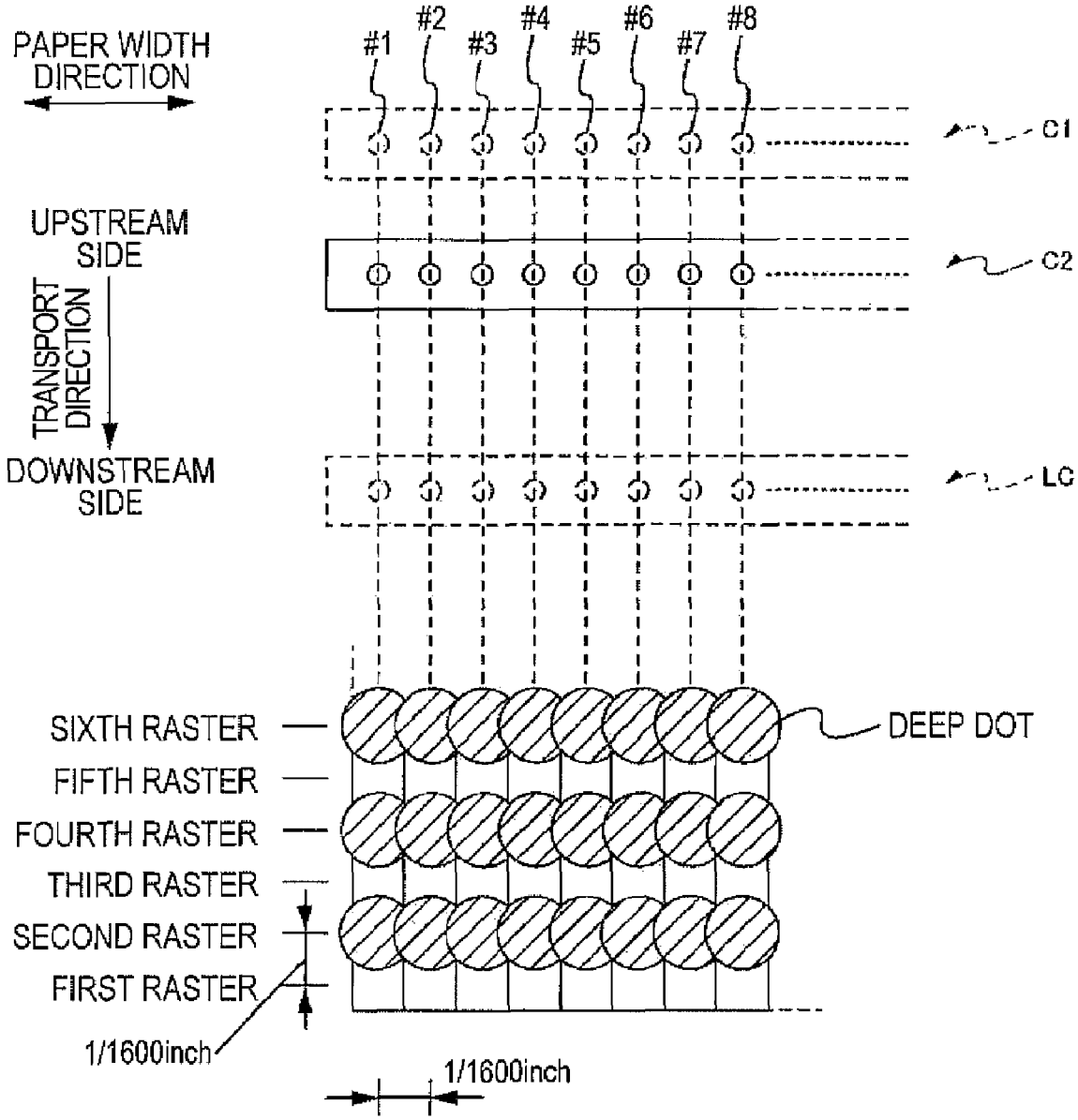
FIG. 11B is an explanatory diagram of a deep dot forming method with a second deep cyan nozzle line in the third embodiment.

FIG. 10 is an explanatory diagram of a dot forming method according to a third embodiment of the invention. FIG. 11A is an explanatory diagram of a deep dot forming method with a first deep cyan nozzle line in the third embodiment. FIG. 11B is an explanatory diagram of a deep dot forming method with a second deep cyan nozzle line in the third embodiment.

Figure 11C:
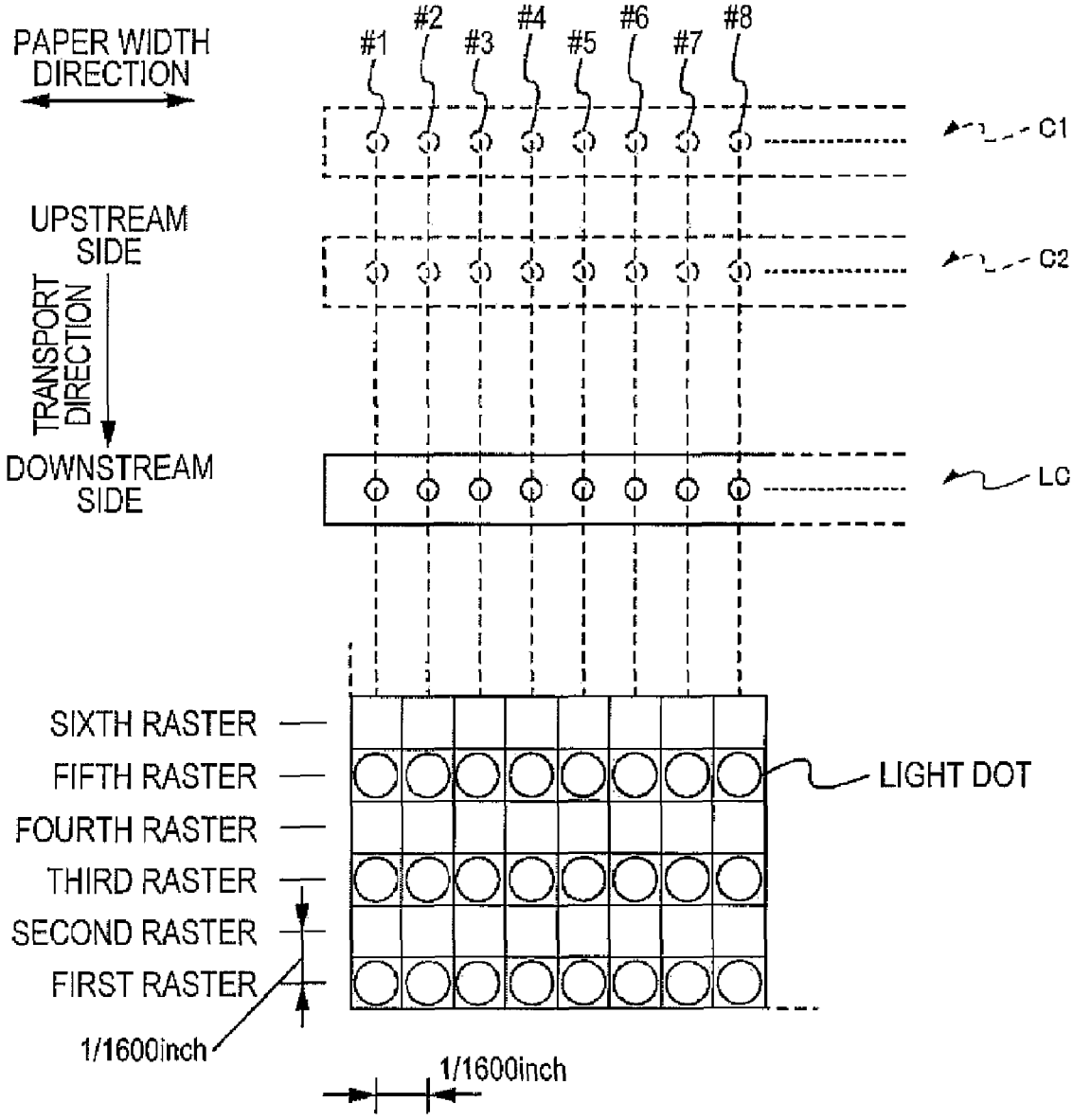
FIG. 11C is an explanatory diagram of a light dot forming method with a light cyan nozzle line in the third embodiment.

FIG. 11C is an explanatory diagram of a light dot forming method with a light cyan nozzle line in the third embodiment.

As shown in FIG. 11A, each of the nozzles in the first deep nozzle line (C1) ejects deep ink when it is opposed to a raster with an odd number, and does not eject deep ink when it is opposed to a raster with an even number, thus forming deep dots every other raster. Further, as shown in FIG. 11B, each of the nozzles in the second deep nozzle line (C2) ejects deep ink when it is opposed to a raster with an even number, and does not eject deep ink when it is opposed to a raster with an odd number, thus forming deep dots every other raster. Further, as shown in FIG. 11C, each of the nozzles in the light nozzle line (LC) ejects light ink when it is opposed to a raster with an odd number, and does not eject light ink when it is opposed to a raster with an even number, thus forming light dots every other raster. As described above, since each of the nozzles forms dots on every other pixel in the transport direction, the paper can be transported a distance corresponding to two pixels during the ejection cycle, thus the print speed is increased.

Also in the third embodiment, there is no need for forming the light dots on all of the pixels, and consequently, the number of light nozzle lines can be set smaller than the number of deep nozzle lines. Therefore, according also to the third embodiment, since the number of nozzle lines of the head unit can be set smaller than in the case of providing the same number of light nozzle lines as that of deep nozzle lines, the manufacturing cost is reduced.

It should be noted that since the ink is ejected also from an adjacent nozzle in the third embodiment, the problem of cross talk between the nozzles should arise.

COMPARATIVE EXAMPLE

Figure 12A:
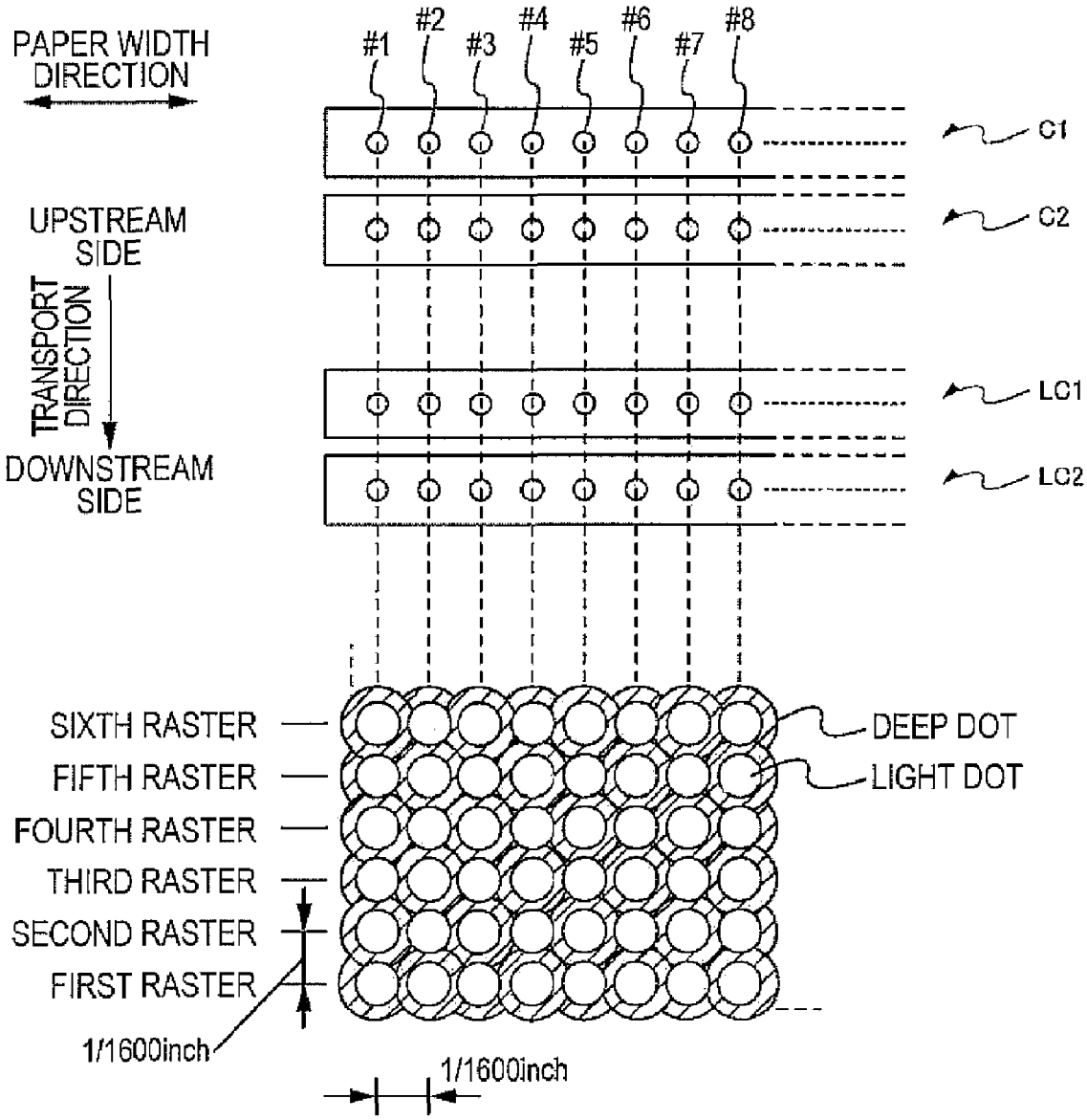
FIG. 12A is an explanatory diagram of a dot forming method of a comparative example.
Figure 12B:
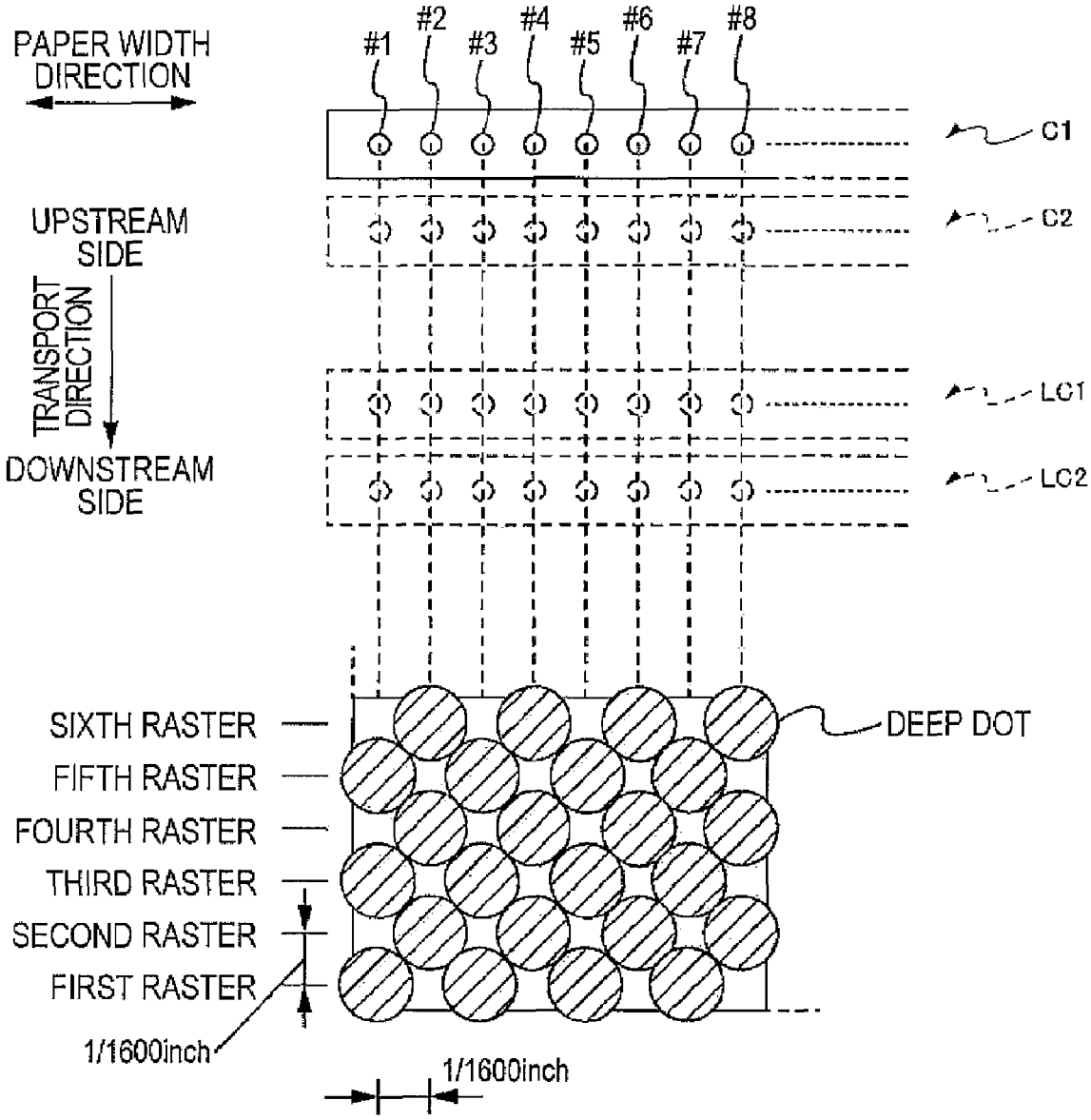
FIG. 12B is an explanatory diagram of a deep dot forming method in the comparative example.
Figure 12C:
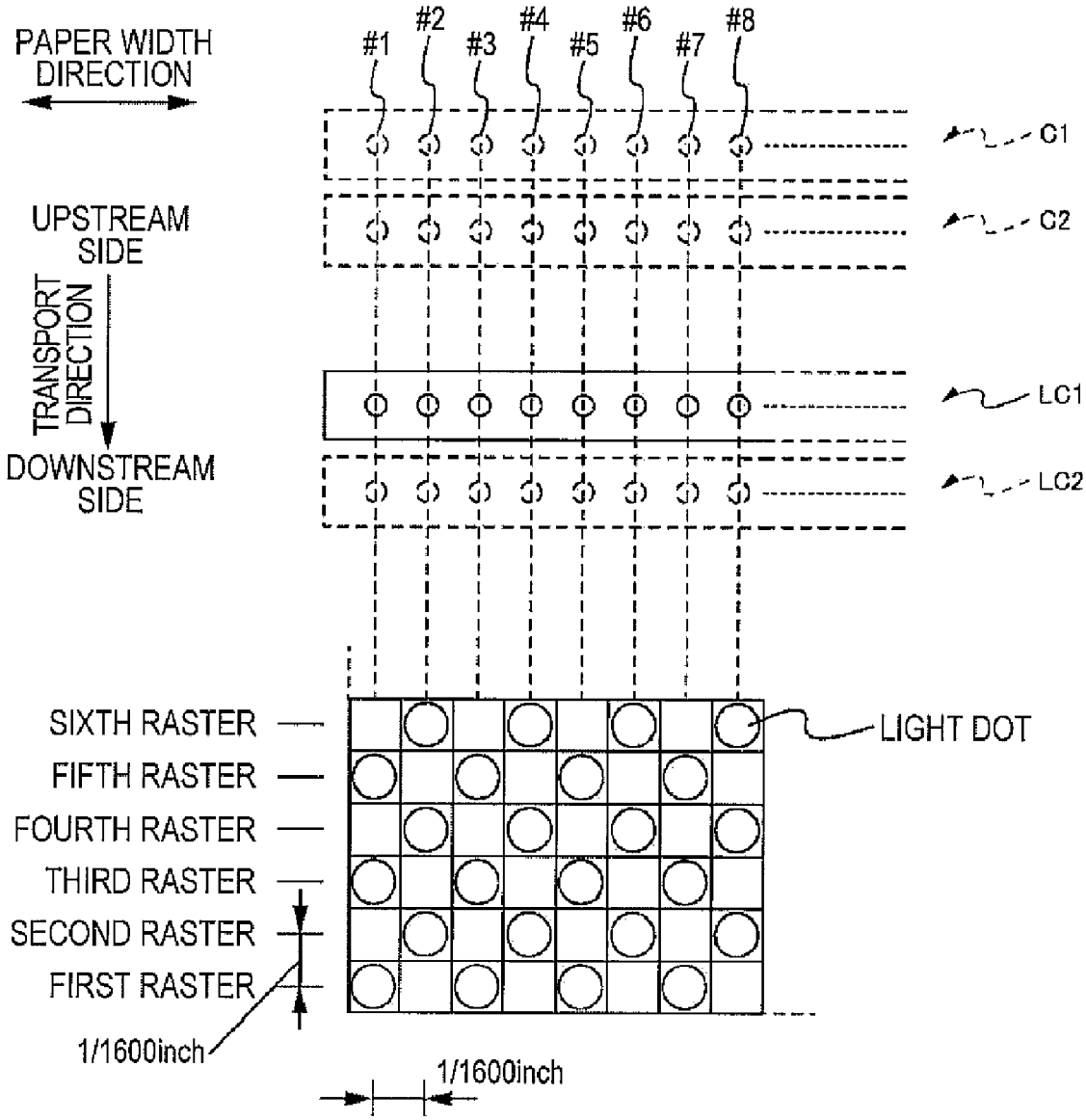
FIG. 12C is an explanatory diagram of a light dot forming method in the comparative example.

FIG. 12A is an explanatory diagram of a dot forming method of a comparative example. FIG. 12B is an explanatory diagram of a deep dot forming method in the comparative example. FIG. 12C is an explanatory diagram of a light dot forming method in the comparative example. Here, the drawings also show conditions provided with the largest number of dots.

The comparative example is different from the first through third embodiments (in the first through third embodiments, the number of light nozzle lines is smaller than the number of deep nozzle lines) in that the number of deep nozzle lines is the same as that of light nozzle lines.

In the comparative example, in the case in which the largest number of dots are formed (the gray-scale (depth) of cyan becomes the highest value), deep dots and light dots are formed on all of the pixels. In order for thus forming the dots, in the comparative example, deep dots are formed on all of the pixels by two deep nozzle lines. Specifically, the first deep nozzle line (C1) forms deep dots in a checkerboard pattern as shown in FIG. 12B, and the second deep nozzle line (C2) forms deep dots on the remaining pixels in a checkerboard pattern. Similar thereto, regarding the light nozzle lines, all of the pixels are provided with light dots by two light nozzle lines in the comparative example. Specifically, the first light nozzle line (CL1) forms light dots in a checkerboard pattern as shown in FIG. 12C, and the second light nozzle line (CL2) forms light dots on the remaining pixels in a checkerboard pattern.

In the comparative example, since two deep nozzle lines and two light nozzle lines are required, the number of nozzles of the head unit increases, thus the manufacturing cost is increased in comparison with the case in which the number of light nozzle lines is decreased as in the embodiments described above.

Further, in the comparative example, there are a large number of pixels on which dots of the same color (cyan, in this case) are formed in a overlapping manner. Therefore, if the colors of the deep ink and the light ink in the first embodiment and the colors of the deep ink and the light ink in the comparative example are respectively adjusted so that the depth of cyan in the case of forming the dots as shown in FIG. 12A and the depth of cyan in the case of forming the dots as shown in FIG. 6 become the same, a variation in the cyan depth with respect to an amount of ink implanted therein is reduced in the comparative example in comparison with the first embodiment. As a result, in the comparative example, an ejection amount of cyan ink in printing an image becomes larger in comparison with the first embodiment.

Other Embodiments

Although a printer as an embodiment of the invention has been explained above, the embodiments described above are are presented to facilitate easier understanding of the invention, and not to provide limited interpretations of the invention. The invention can thus be modified or improved within the scope and spirit thereof, and include equivalents thereof. In particular, the embodiments described below are included in the scope of the invention.

The Number of Nozzle Lines

In the embodiments described above, two deep nozzle lines and a single nozzle line are provided. However, the number of nozzle lines is not limited thereto. For example, a plurality of light nozzle lines can also be provided.

Figure 13:
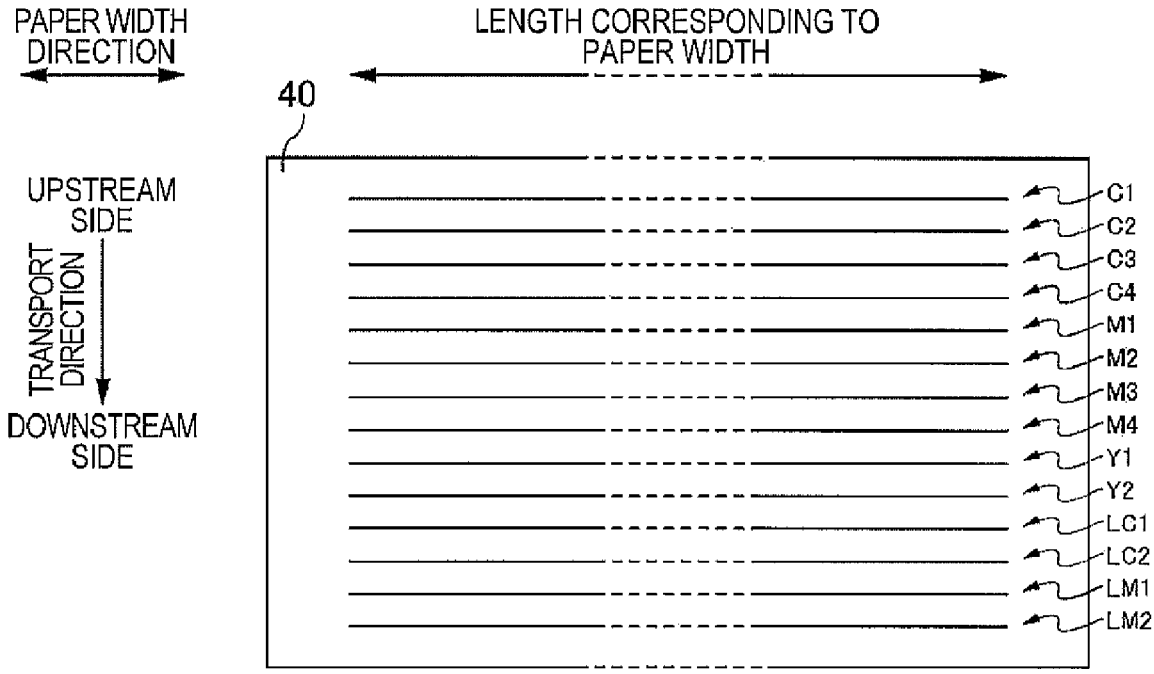
FIG. 13 is an explanatory diagram of an arrangement of a plurality of nozzle lines on a lower surface of the head unit in another embodiment viewed transparently from above.

FIG. 13 is an explanatory diagram of an arrangement of a plurality of nozzle lines on a lower surface of the head unit 40 in another embodiment viewed transparently from above. Fourteen nozzle lines are formed on the lower surface of the head unit 40.

Focusing attention on cyan, four deep nozzle lines and two light nozzle lines are provided. Although not shown in FIG. 13, a first deep nozzle line (C1) and a second deep nozzle line (C2) each form a half of the deep dots (see FIG. 7A) to be formed by the first deep nozzle line (C1) of the first embodiment, and the two deep nozzle lines form the deep dots in a checkerboard pattern as formed by the first deep nozzle line (C1) of the first embodiment. Similar to the above case, a third deep nozzle line (C3) and a fourth deep nozzle line (C4) form deep dots (see FIG. 7B) in a checkerboard pattern as formed by the second deep nozzle line (C2) of the first embodiment. Further, a first light nozzle line (LC1) and a second light nozzle line (LC2) form light dots (see FIG. 7C) in a checkerboard pattern as formed by the light nozzle line (LC) of the first embodiment. The light nozzle line forms light dots at the same positions as those of the deep dots formed by the first deep nozzle line (C1) and the second deep nozzle line (C2).

Also in this embodiment, there is no need for forming light dots on all of the pixels, and consequently, the number of light nozzle lines can be set smaller than the number of deep nozzle lines. Therefore, since the number of nozzle lines of the head unit can be set smaller than in the case of providing the same number of light nozzle lines as that of deep nozzle lines, the manufacturing cost is reduced.

Line Printer

In the embodiments described above, a line printer is described that performs printing by ejecting ink from the nozzle lines with a length corresponding to the paper width while transporting the paper. However, it should be noted that the invention can be applied not only to line printers but also to other types of printers.

Figure 14A:
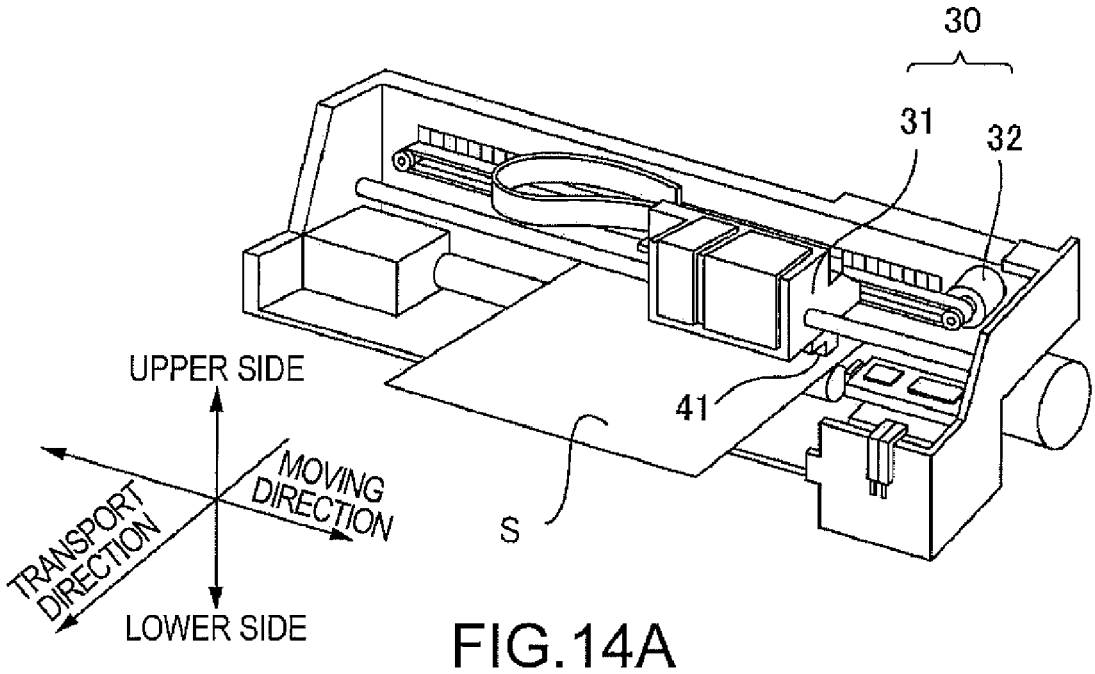
FIG. 14A is an explanatory diagram of another printer.

FIG. 14A is an explanatory diagram of another printer. The printer is provided with a carriage unit 30 including a carriage 31 and a carriage motor 32. The carriage has a head 41 disposed in the lower part thereof.

Figure 14B:
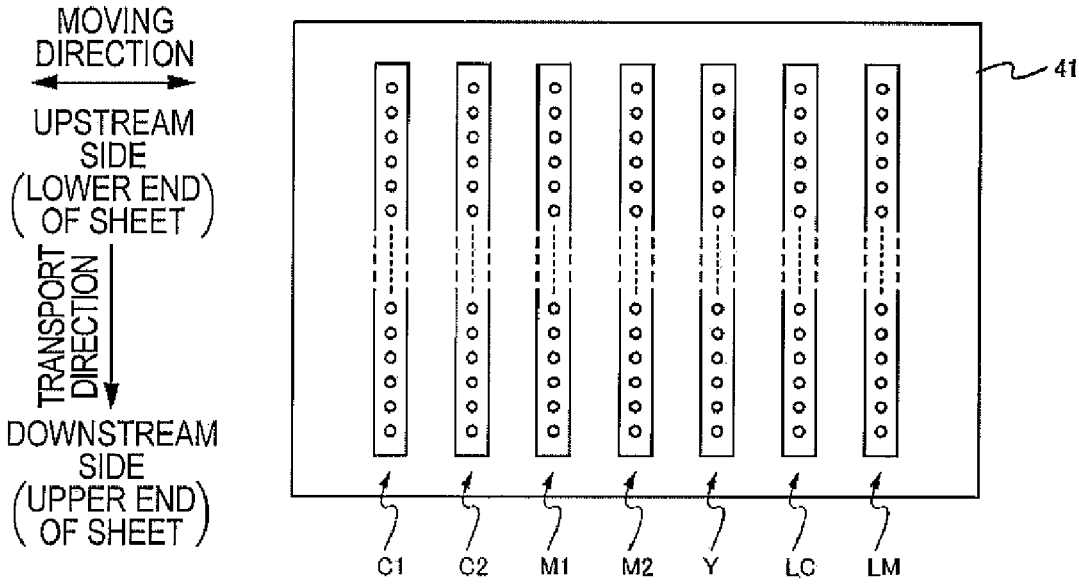
FIG. 14B is an explanatory diagram of an arrangement of a plurality of nozzle lines on a lower surface of a head viewed transparently from above.

FIG. 14B is an explanatory diagram of an arrangement of a plurality of nozzle lines on a lower surface of a head 41 viewed transparently from above. On the lower surface of the head 41, seven nozzles are aligned along a moving direction thereof. Focusing attention on cyan, two deep nozzle lines are provided, while only a single nozzle line is provided. Each of the nozzle lines is composed of a plurality of nozzles aligned in the transport direction with a predetermined nozzle pitch.

Further, a controller (not shown) of the printer performs printing by controlling the carriage unit 30, a head unit including the head 41, and a transport unit to repeat alternatively a dot forming operation for ejecting ink from the nozzle lines moving in the moving direction and a transport operation for transporting the paper in the transport direction.

Figure 15:
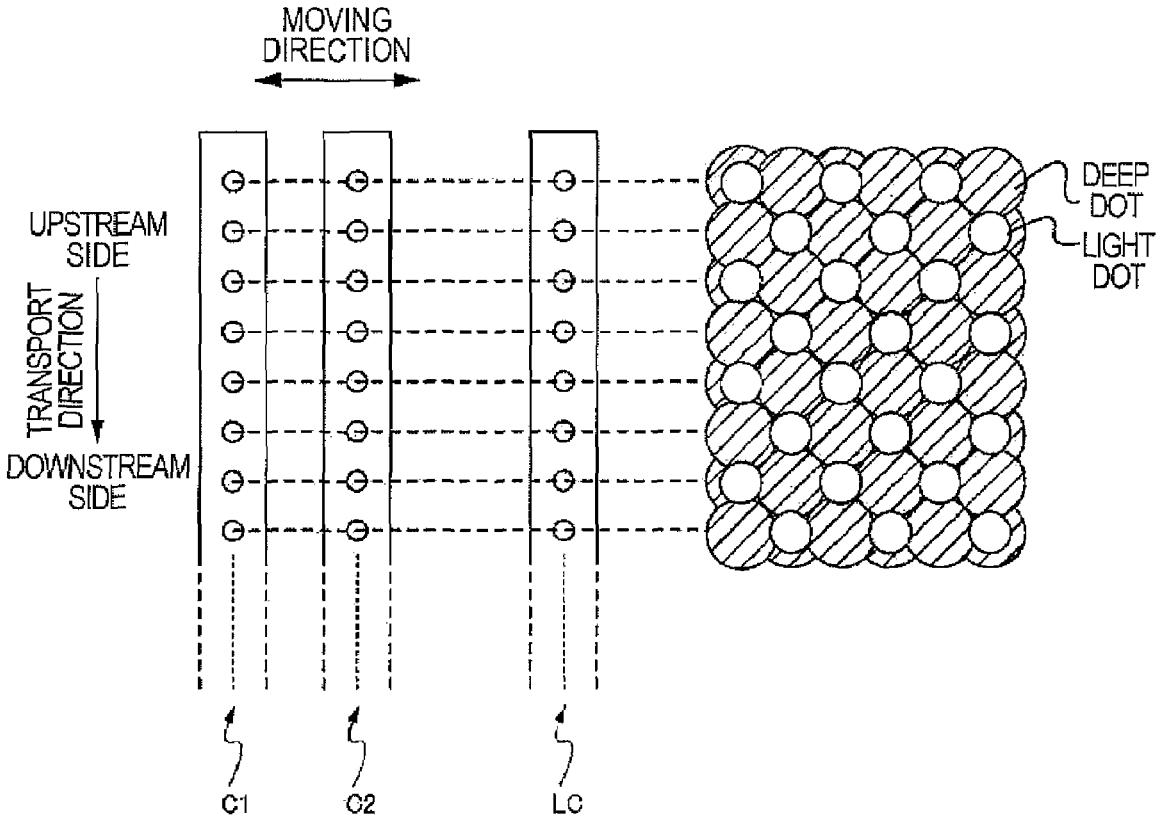
FIG. 15 is an explanatory diagram of a dot forming method of another printer.

FIG. 15 is an explanatory diagram showing the dot forming operation performed during the transport operation. As shown in FIG. 15, the first deep nozzle line (C1) forms deep dots in a checkerboard pattern, the second deep nozzle line (C2) forms deep dots in a checkerboard pattern between the dots formed in a checkerboard pattern by the first deep nozzle line (C1), and the light nozzle line (LC) forms light dots in a checkerboard pattern. This configuration provides the same advantages as in the first embodiment described above.

Positional Relationship Between Light Cyan Dots and Light Magenta Dots

Although in the embodiments described above, pixels on which light dots of magenta are formed and pixels on which light dots of cyan are formed are different from each other, this is not a limitation. The pixels provided with light dots of magenta and the pixels provided with light dots of cyan can be the same. According to this configuration, if light dots are formed at positions shifted from ideal positions, deterioration of granularity can be prevented from becoming conspicuous in an area with a faint color in the print image. Further, in an area with a deep color in the print image, if a light dot of cyan is not formed on a pixel on which a light dot of magenta is formed, a color shift to magenta occurs in that pixel. Further, if a light dot of cyan is formed on a pixel on which a light dot of magenta is not formed, a color shift to cyan occurs in that pixel. Further, if a color shift to magenta occurs in some pixels while a color shift to cyan occurs in other pixels, the image quality is degraded in representing black or gray. For such reasons, light dots of magenta and light dots of cyan may be disposed on the same pixels.

Thus, the color shift is reduced in representing black or gray to improve the image quality.

Here, in the case in which light dots of cyan and light dots of magenta are disposed on the same pixels, yellow dots are preferably also disposed on the same pixels as in the case with the light dots of cyan and magenta. Since the pixels on which light dots of cyan and magenta are disposed become deeper in cyan and magenta in comparison with pixels on which no light dots are disposed, the color shift can be reduced in representing gray color by forming yellow dots on such pixels. If yellow dots are disposed on pixels on which light dots of cyan or magenta are not disposed, a color shift to yellow occurs in pixels with yellow dots disposed thereon while a color shift to cyan or magenta occurs in pixels on which light dots of cyan or magenta are disposed.

Liquid Ejection Device

In the embodiments described above, the inkjet printer is explained as an example of a liquid ejection device for ejecting a liquid. However, it should be noted that the liquid ejection device of the invention is not limited to a printer.

The present invention can be applied to various kinds of liquid ejection devices using inkjet technology such as color filter manufacturing devices, dyeing devices, fine processing devices, semiconductor manufacturing devices, surface processing devices, three-dimensional modeling devices, liquid vaporizing devices, organic EL manufacturing devices (in particular, polymer EL manufacturing devices), display manufacturing devices, deposition devices, or DNA chip manufacturing devices. Further, methods therefore and manufacturing methods can also be included in a range of applications.

Nozzle the embodiments described above, ink is ejected using a heater. However, the invention is not limited thereto, and other methods such as ejecting the ink using a piezoelectric element can also be used.

What is claimed is:

1. A liquid ejection device comprising:

a plurality of deep nozzle lines each having a plurality of nozzles in a predetermined direction, for ejecting a first liquid;

a smaller number of light nozzle lines than the number of the deep nozzle lines, each having a plurality of nozzles in the predetermined direction, for ejecting a second liquid having a lighter color depth than the first liquid; and a controller that forms deep dots on pixels on a medium using the plurality of deep nozzle lines, and that forms light dots on a smaller number of pixels than the number of the pixels on which the deep dots are formed using the smaller number of light nozzle lines.

2. The liquid ejection device according to claim 1, wherein when liquid is ejected from one of the nozzles, liquid is not ejected from a nozzle adjacent to the one of the nozzles.

3. The liquid ejection device according to claim 1, wherein when one of the nozzles forms a dot on one of the pixels, a dot is not formed on another of the pixels which the one of the nozzles is opposed to subsequently to the one of the pixels.

4. The liquid ejection device according to claim 1, wherein the plurality of deep nozzle lines includes a first deep nozzle line and a second deep nozzle line, the first deep nozzle line forms deep dots, and then the second deep nozzle line forms deep dots, and each of the light nozzle lines forms light dots selectively not on pixels on which deep dots are formed by the second deep nozzle line but on pixels on which deep dots are formed by the first deep nozzle line.

5. The liquid ejection device according to claim 1, wherein the deep dots are larger than the light dots.

6. The liquid ejection device according to claim 1, wherein the plurality of deep nozzle lines includes a plurality of deep cyan nozzle lines for ejecting deep cyan ink as the first liquid to form deep cyan dots as the deep dots, the light nozzle lines include a light cyan nozzle line for ejecting light cyan ink as the second liquid to form light cyan dots as the light dots, the liquid ejection device further comprising:

a plurality of deep magenta nozzle lines each having a plurality of nozzles in the predetermined direction, for ejecting deep magenta ink to form deep magenta dots; and a smaller number of light magenta nozzle lines than the number of the deep nozzle lines, each having a plurality of nozzles in the predetermined direction, for ejecting light magenta ink having a lighter color depth than the deep magenta ink to form light magenta dots, wherein the light magenta dots are disposed between the light cyan dots.

7. An inkjet printer comprising the liquid ejection device according to claim 1.

8. A line printer comprising the liquid ejection device according to claim 1.

9. A liquid ejection method comprising:

forming deep dots on pixels on a medium by ejecting a first liquid using a plurality of deep nozzle lines each having a plurality of nozzles in a predetermined direction; and forming light dots on a smaller number of pixels than the number of the pixels on which the deep dots are formed by ejecting a second liquid having a lighter color depth than the first liquid using a smaller number of light nozzle line(s) than the number of the deep nozzle lines, each having a plurality of nozzles in the predetermined direction.

10. The liquid ejection method according to claim 9, wherein when liquid is ejected from one of the nozzles, liquid is not ejected from a nozzle adjacent to the one of the nozzles.

11. The liquid ejection method according to claim 9, wherein when one of the nozzles forms a dot on one of the pixels, a dot is not formed on another of the pixels which the one of the nozzles is opposed to subsequently to the one of the pixels.

12. The liquid ejection method according to claim 9, wherein the plurality of deep nozzle lines includes a first deep nozzle line and a second deep nozzle line, the first deep nozzle line forms deep dots, and then the second deep nozzle line forms deep dots, and each of the light nozzle lines forms light dots selectively not on pixels on which deep dots are formed by the second deep nozzle line but on pixels on which deep dots are formed by the first deep nozzle line.

13. The liquid ejection method according to claim 9, wherein the deep dots are larger than the light dots.

14. The liquid ejection method according to claim 9, wherein the plurality of deep nozzle lines includes a plurality of deep cyan nozzle lines for ejecting deep cyan ink as the first liquid to form deep cyan dots as the deep dots, the light nozzle lines include a light cyan nozzle line for ejecting light cyan ink as the second liquid to form light cyan dots as the light dots, the liquid ejection method further comprising:

ejecting deep magenta ink to form deep magenta dots using a plurality of deep magenta nozzle lines each having a plurality of nozzles in the predetermined direction; and ejecting light magenta ink having a lighter color depth than the deep magenta ink to form light magenta dots using a smaller number of light magenta nozzle lines than the number of the deep nozzle lines, each having a plurality of nozzles in the predetermined direction, wherein the light magenta dots are disposed between the light cyan dots.

* * * * *